US011724861B2

(12) United States Patent
Miller et al.

(10) Patent No.: US 11,724,861 B2
(45) Date of Patent: Aug. 15, 2023

(54) DECORATIVE CLOSURE FOR A CONTAINER

(71) Applicant: Vinventions USA, LLC, Zebulon, NC (US)

(72) Inventors: Darrell James Miller, Holly Springs, NC (US); Olav Marcus Aagaard, Rotterdam (NL); Christine Phi Phuong Duong, Paris (FR)

(73) Assignee: VINVENTIONS USA, LLC, Zebulon, NC (US)

( * ) Notice: Subject to any disclaimer, the term of this patent is extended or adjusted under 35 U.S.C. 154(b) by 572 days.

(21) Appl. No.: 16/555,422

(22) Filed: Aug. 29, 2019

(65) Prior Publication Data

US 2020/0071034 A1 Mar. 5, 2020

Related U.S. Application Data

(60) Provisional application No. 62/725,473, filed on Aug. 31, 2018.

(51) Int. Cl.
*B65D 39/00* (2006.01)
*B65D 65/46* (2006.01)
(Continued)

(52) U.S. Cl.
CPC ..... *B65D 39/0011* (2013.01); *B65D 51/245* (2013.01); *B65D 65/466* (2013.01); *B67B 1/04* (2013.01)

(58) Field of Classification Search
CPC ..... B65D 39/0011; B65D 51/245; B65D 65/466; B67B 1/04
See application file for complete search history.

(56) References Cited

U.S. PATENT DOCUMENTS 1,758,946 A * 5/1930 Grupe ..... B27N 3/24 264/103
4,042,543 A * 8/1977 Strickman ..... C08L 23/06 215/355

(Continued)

FOREIGN PATENT DOCUMENTS

AR 098858 A1 6/2016
AU 2061295 A 10/1995

(Continued)

OTHER PUBLICATIONS

Jeff Leve, The wine cellar insider, Oct. 2016 https://web.archive.org/web/20161005222342/https://www.thewinecellarinsider.com/wine-topics/wine-educational-questions/corked-wine-cause-solution-totell-wine-corked/.*

(Continued)

*Primary Examiner* — Andrew M Tecco
*Assistant Examiner* — Nicholas E Igbokwe
(74) *Attorney, Agent, or Firm* — Withrow & Terranova, P.L.L.C.; Vincent K. Gustafson

(57) ABSTRACT

A closure constructed for being inserted and securely retained in a portal-forming neck of a container, the closure having a substantially cylindrical shape and comprising substantially flat terminating surfaces forming the opposed ends of the closure, wherein the closure further comprises: (a) a closure precursor having a substantially cylindrical shape and comprising a lateral surface and substantially flat terminating surfaces forming the opposed ends of the closure precursor, wherein the lateral surface and the flat terminating surfaces of the closure precursor have a substantially uniform color; and (b) a decorative layer that at least partially covers at least the lateral surface of the closure precursor.

56 Claims, 2 Drawing Sheets

(51) Int. Cl.
*B65D 51/24* (2006.01)
*B67B 1/04* (2006.01)

(56) References Cited

U.S. PATENT DOCUMENTS

| | | | | |
|---|---|---|---|---|
| 4,111,323 | A * | 9/1978 | Ichinose | B65D 41/12 215/230 |
| 4,664,275 | A * | 5/1987 | Kasai | B65D 39/0023 215/247 |
| 5,317,047 | A | 5/1994 | Sabate et al. | |
| 5,665,462 | A | 9/1997 | Dewar | |
| 7,993,743 | B2 | 8/2011 | Taylor | |
| 8,063,163 | B2 | 11/2011 | Hatke et al. | |
| 2003/0102283 | A1 | 6/2003 | Fox | |
| 2006/0006132 | A1 * | 1/2006 | Lauer | B65D 39/0005 220/796 |
| 2007/0203266 | A1 * | 8/2007 | Holmes | B65D 39/0011 524/13 |
| 2009/0130350 | A1 | 5/2009 | Lauer et al. | |
| 2011/0180442 | A1 * | 7/2011 | Bost | B65D 39/0058 206/459.5 |
| 2013/0327739 | A1 * | 12/2013 | Davidts | B65D 39/0058 427/244 |
| 2014/0224759 | A1 * | 8/2014 | Aagaard | B32B 25/045 427/323 |
| 2016/0325535 | A1 * | 11/2016 | Ueno | B32B 27/36 |
| 2018/0037373 | A1 * | 2/2018 | Morel | B29C 48/00 |
| 2018/0118432 | A1 | 5/2018 | Fresnel | |
| 2018/0362198 | A1 * | 12/2018 | Volpe | D01F 8/14 |

FOREIGN PATENT DOCUMENTS

| | | | |
|---|---|---|---|
| CN | 101861274 | A | 10/2010 |
| FR | 2799183 | A1 | 4/2001 |
| WO | 9628378 | A1 | 9/1996 |
| WO | 0064649 | A1 | 11/2000 |
| WO | 03018304 | A1 | 3/2003 |

OTHER PUBLICATIONS

International Search Report and Written Opinion for International Patent Application No. PCT/US2019/044378, dated Nov. 13, 2019, 14 pages.
First Office Action for Chinese Patent Application No. 201980056139.9, dated Mar. 17, 2022, 25 pages.
Author Unknown, "Calprene & Solprene SBS," Product Brochure, Dec. 2016, Dynasol Group, retrieved Nov. 25, 2019 from http://dynasolgroup.com/wp-content/uploads/2016/12/Catalog_Dynasol_Group_2016_baja.pdf, 17 pages.
Author Unknown, "Dryflex TPE," 2019, Distrupol, retrieved Nov. 25, 2019 from https://www.distrupol.com/dryflex-tpe-compounds.html, 2 pages.
Author Unknown, "Dynaflex™ Thermoplastic Elastomers," 2015, PolyOne, Retrieved Feb. 14, 2019 from http://www.polyone.com/products/thermoplastic-elastomers/gls-dynaflex-thermoplastic-elastomers, 2 pages.
Author Unknown, "ecoflex® F Blend C1200: Biodegradable polyester for compostable film," Product Information, Version 1.0, Jan. 2013, BASF SE, Retrieved Feb. 1, 2018 from https://www.plasticsportal.net/wa/plasticsEU~en . . . /Ecoflex_F_Blend_C1200.pdf, 3 pages.
Author Unknown, "Elastocon TPE—TPE Products," 2019, Elastocon TPE Technologies, Inc., Retrieved Feb. 14, 2019 from https://www.elastocontpe.com/tpe-products/, 2 pages.
Author Unknown, "Elastollan®," Product Brochure, BASF, retrieved Nov. 25, 2019 from https://www.basf.com/kr/documents/ko/product/Thermoplastis%20Polyurethan_Think,%20Create%20Elastollan.pdf, 64 pages.
Author Unknown, "Elexar®: Wired for Performance," 2019, Teknor Apex, Retrieved Feb. 14, 2019 from https://www.teknorapex.com/elexar-tpes-for-flexible-cords-and-cables, 1 page.
Author Unknown, "EUROPRENE® SOL T/Th TPR," Oct. 2018, Versalis S.p.A., Retrieved Feb. 14, 2019 from https://www.versalis.eni.com/irj/go/km/docs/versalis/Contenuti%20Versalis/EN/Documenti/Prodotti/Elastomeri/Brochure/TPR_violetto_ESE_02.pdf, 10 pages.
Author Unknown, "Evoprene®," 2018, Mexichem Specialty Compounds, Inc., Retrieved Feb. 14, 2018 from https://www.mexichemspecialtycompounds.com/brands/evoprene/browse/?technology=2&market=5, 4 pages.
Author Unknown, "Globalprene Thermoplastic Elastomers," LCY Chemical Corporation, Retrieved Feb. 14, 2019 from https://www.lcygroup.com/lcy/en/SBC.php, 3 pages.
Author Unknown, "Hydrocerol®: Chemical Foaming & Nucleating Agents," Product Data Sheet Additive Masterbatches, Dec. 18, 2018, Clariant International Ltd., Retrieved Feb. 1, 2018 from https://www.clariant.com/polska/en/products/additives/hydrocerol, 2 pages.
Author Unknown, "Invision®," A. Schulman, Inc., Retrieved Feb. 14, 2019 from https://www.aschulman.com/products/engineered-thermoplastics, 1 page.
Author Unknown, "KRATON™ Products," 2019, Kraton Corporation, Retrieved Feb. 14, 2019 from http://kraton.com/products/KRATON_D_SIS.php, 19 pages.
Author Unknown, "LEOSTOMER®," Riken Technos Corp, Retrieved Feb. 14, 2019 from https://www.rikentechnos.co.jp/e/product/item/plug-e/, 5 pages.
Author Unknown, "Maxelast® TPEs," Nantong Polymax Elastomer Technology Co., Ltd., Retrieved Feb. 1, 2018 from www.apstpe.com/maxelast, 6 pages.
Author Unknown, "megol® SEBS Compounds—TPE," 2018, API, Retrieved Feb. 14, 2019 from https://www.apiplastic.com/en/products/tpes/tpe-s/megol/, 12 pages.
Author Unknown, "Monprene® Thermoplastic Elastomer Compounds (TPEs)," 2019, Teknor Apex, Retrieved Feb. 14, 2019 from https://www.teknorapex.com/monprene-tpes-for-consumer-products-and-packaging, 2 pages.
Author Unknown, "Multi-Flex® TEA 4001-35," Product Data Sheet, Multibase, 2019, UL LLC, Retrieved Feb. 14, 2019 from https://plastics.ulprospector.com/datasheet/e57156/multi-flex-tea-4001-35, 2 pages.
Author Unknown, "Multi-Flex® TPE Plastic Materials Supplied by Multibase, a Down Corning Company," 2019, UL LLC, Retrieved Feb. 14, 2019 from https://plastics.ulprospector.com/materials/693/multi-flex-tpe, 5 pages.
Author Unknown, "OnFlex™ Thermoplastic Elastomers," 2015, PolyOne, Retrieved Feb. 14, 2019 from http://www.polyone.com/products/thermoplastic-elastomers/gls-onflex-thermoplastic-elastomers, 3 pages.
Author Unknown, "Quintac Series," Zeon Corporation, Retrieved Feb. 14, 2019 from http://www.zeon.co.jp/business_e/enterprise/chemical/chemical5.html, 2 pages.
Author Unknown, "Raplan," API, Retrieved Feb. 14, 2019 from https://www.apiplastic.com/en/products/tpes/tpe-s/raplan/, 1 page.
Author Unknown, "RTP 2700 Series: SBC-Based Thermoplastic Elastomers," Product Brochure, Dec. 2016, RTP Company, Retrieved Feb. 14, 2019 from https://www.rtpcompany.com/wp-content/uploads/RTP-Co_RTP-2700-Series_121316.pdf, 4 pages.
Author Unknown, "Sarlink® TPV and TPE," 2019, Teknor Apex, Retrieved Feb. 14, 2019 from https://www.teknorapex.com/sarlink-tpv-thermoplastic-vulcanizate-and-tpe, 2 pages.
Author Unknown, "Sevrene® Styrenic Block Copolymers," 2019, Vi-Chem Corporation, retrieved Nov. 25, 2019 from http://www.vichem.com/sevrene.html, 3 pages.
Author Unknown, "Styroflex®: Styrene/Butadiene Block Copolymer (SBS)," 2005, BASF Corporation, Retrieved Feb. 1, 2019 from www2.basf.us/PLASTICSWEB/displayanyfile?id=0901a5e1800d4e3a, 4 pages.
Author Unknown, "Styrolux®: Styrene-Butadiene Copolymer Resins," Fact Sheet, 2003, BASF Corporation, Retrieved Feb. 1, 2018 from http://www2.basf.us/PLASTICSWEB/displayanyfile?id=0901a5e180005b45, 2 pages.
Author Unknown, "SUNPRENE™," 2016, Mitsubishi Chemical Corporation, Retrieved Feb. 14, 2019 from https://www.mcpp-global.com/en/america/products/brand/sunprenetm/, 4 pages.

(56) References Cited

OTHER PUBLICATIONS

Author Unknown, "THERMOLAST®," Kraiburg TPE, Retrieved Feb. 14, 2019 from https://www.kraiburg-tpe.com/en/products/thermolast/overview, 1 page.
Author Unknown, "TOPAS® ELASTOMER E-140," Data Sheet, Jan. 14, 2015, TOPAS Advanced Polymers, Retrieved Feb. 1, 2019 from https://topas.com/sites/default/files/PDS%20Topas%20E-140.pdf, 1 page.
Author Unknown, "TUFPRENE™ ASAPRENE™ T," Product Brochure, Aug. 2018, Asahi Kasei, Retrieved Feb. 14, 2019 from https://www.akelastomer.com/eng/brochures/tr_eng.pdf, 11 pages.
Author Unknown, "TPV: Shaping the future with Santoprene™ thermoplastic vulcanizates (TPVs)," Exxon Mobil Corporation, Retrieved Feb. 14, 2019 from https://www.exxonmobilchemical.com/en/products/tpv, 3 pages.
Author Unknown, "VECTOR® Styrenic Block Copolymers," Product Brochure, May 2017, TSRC DEXCO, retrieved Nov. 25, 2019 from https://www.tsrc.com.tw/app/uploads/2016/09/General_EN_Shrink2017-05.pdf, 11 pages.
Author Unknown, "Versaflex™ Thermoplastic Elastomers," 2015, PolyOne, Retrieved Feb. 14, 2019 from http://www.polyone.com/products/thermoplastic-elastomers/gls-versaflex-thermoplastic-elastomers, 3 pages.
Author Unknown, "Versalloy™ Thermoplastic Elastomers," 2015, PolyOne, Retrieved Feb. 14, 2019 from http://www.polyone.com/products/thermoplastic-elastomers/gls-versalloy-thermoplastic-elastomers, 1 page.
Author Unknown, "Versollan™ Thermoplastic Elastomers," 2015, PolyOne, Retrieved Feb. 14, 2019 from http://www.polyone.com/products/thermoplastic-elastomers/gls-versollan-thermoplastic-elastomers, 1 page.
Council of Europe, "Resolution ResAP(2004)2: on cork stoppers and other cork materials and articles intended to come into contract with foodstuffs," Adopted by the Committee of Ministries on Dec. 4, 2004 at the 907th Meeting of the Ministers' Deputies, Strasbourg Cedex, France, Retrieved Feb. 2, 2018 from https://search.coe.int/cm/Pages/result_details.aspx?ObjectId=09000016805db887, 4 pages.
Kabasci, S., "Bio-Based Plastics: Materials and Applications," John Wiley & Sons, Ltd., 2014, 389 pages.
Author Unknown, "SEPTON™ HYBRAR™: Kuraray's Thermoplastic Elastomers," Sep. 2016, Kuraray America, Inc., Retrieved Feb. 1, 2018 from https://www.elastomer.kuraray.com/fileadmin/user_upload/ELASTOMERE/DOWNLOADS/product_brochures/Septon_and_Hybrar.pdf, 8 pages.
Office Action for Argentinian Patent Application No. 20190102474, dated Oct. 18, 2022, 10 pages.
Examination Report No. 2 for Australian Patent Application No. 2019329382, dated Mar. 15, 2023, 3 pages.

* cited by examiner

DECORATIVE CLOSURE FOR A CONTAINER

CROSS-REFERENCE TO RELATED APPLICATIONS

The present application claims priority to U.S. Provisional Patent Application Ser. No. 62/725,473 filed on Aug. 31, 2018 entitled "DECORATIVE CLOSURE FOR A CONTAINER," wherein the contents of such application are hereby incorporated by reference herein in their entirety.

TECHNICAL FIELD

The present disclosure relates to a closure for a container including, but not limited to a wine bottle. The present disclosure also relates to a method for applying a decorative layer on a closure precursor, the closure precursor being constructed for being inserted and securely retained in a container.

BACKGROUND

In view of the wide variety of products that are sold for being dispensed from containers, particularly containers with round necks which define the dispensing portal, numerous constructions have evolved for container stoppers or closure means for the portals, including for example screw caps, stoppers, corks and crown caps, to name a few. Generally, products such as vinegar, vegetable oils, laboratory liquids, detergents, honey, condiments, spices, alcoholic beverages, and the like, have similar needs regarding the type and construction of the closure means used for containers for these products. However, wine sold in bottles represents the most demanding product in terms of bottle closure technology. In an attempt to best meet these demands, most wine bottle closures or stoppers have been produced from cork, a natural material.

While natural cork remains a dominant material for wine closures, wine closures made from alternative materials, such as polymers, also referred to as synthetic closures, have become increasingly popular, largely due to the shortage in high quality natural cork material and the awareness of wine spoilage as a result of "cork taint," a phenomenon that is associated with natural cork materials. Synthetic closures have the advantage that by means of closure technology, their material content and physical characteristics can be designed, controlled and fine-tuned to satisfy the varying demands that the wide range of different wine types produced throughout the world impose on closures.

One of the principal difficulties to which any bottle closure is subjected in the wine industry is the manner in which the closure is inserted into the bottle. Typically, the closure is placed in a jaw clamping member positioned above the bottle portal. The clamping member incorporates a plurality of separate and independent jaw members which peripherally surround the closure member and are movable relative to each other to compress the closure member to a diameter substantially less than its original diameter. Once the closure member has been fully compressed, a plunger moves the closure means from the jaws directly into the neck of the bottle, where the closure member is capable of expanding into engagement with the interior diameter of the bottle neck and portal, thereby sealing the bottle and the contents thereof.

In view of the fact that the jaw members are generally independent of each other and separately movable in order to enable the closure member to be compressed to the substantially reduced diameter, each jaw member comprises a sharp edge which is brought into direct engagement with the closure member when the closure member is fully compressed. Score lines are frequently formed on the outer surface of the closure member, which prevents a complete, leak-free seal from being created when the closure member expands into engagement with the bottle neck. This can occur, for example, if the jaw members of the bottling equipment are imperfectly adjusted or worn. Leakage of the product, particularly of liquid product, from the container can occur.

It is generally desirable that any bottle closure be able to withstand this conventional bottling and sealing method. Furthermore, many cork sealing members also incur damage during the bottling process, resulting in leakage or tainted wine.

Another issue in the wine industry is the capability of the wine stopper to withstand a pressure build up that can occur during storage of the wine product after it has been bottled and sealed. Due to natural expansion of the wine, for example during hotter months, pressure builds up, which can result in the bottle stopper being displaced from the bottle. As a result, it is generally desirable that the bottle stopper employed for wine products be capable of secure, intimate, frictional engagement with the bottle neck in order to resist any such pressure build up.

A further issue in the wine industry is the general desirability that secure, sealed engagement of the stopper with the neck of the bottle be achieved quickly, if not virtually immediately after the stopper is inserted into the neck of the bottle. During normal wine processing, the stopper is compressed, as detailed above, and inserted into the neck of the bottle to enable the stopper to expand in place and seal the bottle. Such expansion desirably occurs immediately upon insertion into the bottle since many processors tip the bottle onto its side or neck down after the stopper is inserted into the bottle neck, allowing the bottle to remain stored in this position for extended periods of time. If the stopper is unable rapidly to expand into secure, intimate, frictional contact and engagement with the walls of the neck of the bottle, wine leakage can occur.

It is further desirable that the closure be removable from the bottle using a reasonable extraction force. Although actual extraction forces extend over a wide range, the generally accepted, conventional extraction force is typically below 100 pounds (445 Newtons).

In achieving a commercially viable stopper or closure, a careful balance must be made between secure sealing and providing a reasonable extraction force for removal of the closure from the bottle. Since these two characteristics are believed to be in direct opposition to each other, a careful balance must be achieved so that the stopper or closure is capable of securely sealing the product, in particular the wine in the bottle, preventing or at least reducing both leakage and gas transmission, while also being removable from the bottle without requiring an excessive extraction force.

Furthermore, it is generally desirable to effectively prevent or reduce oxygen from entering the bottle. Too much oxygen can cause the premature spoilage of wine. In fact, oxidation may occur over a period of time to render the beverage undrinkable. Thus, it is generally desirable that the closure has a low oxygen permeability in order to extend and preserve the freshness and shelf life of the product. Any commercially viable wine stopper or closure should therefore generally have a low oxygen transfer rate (OTR). It is also possible to incorporate additives that act as oxygen scavengers into the closure. A combination of low closure permeability to oxygen and incorporation of oxygen scavengers can be effective at reducing oxygen-mediated spoilage of wine.

In addition to the above, it is also desirable, for economic and environmental reasons, to reduce the total amount of material in a closure made from materials such as polymers, particularly the amount of polymer material. Since the size of the closure is determined by the size of the bottle neck, reducing the amount of material can principally be achieved by reducing the density of the closure, in particular of the core member, which is generally in the form of a foamed material comprising air- or gas-filled cells. However, reducing the density of the core member generally increases the deformability of the core member and thus of the closure, which in turn results in a worsened sealing capability and increased leakage. In order to avoid this, a thicker and/or denser outer layer or skin is conceivable, as is the incorporation of a stiffer and/or denser central element within the core member. However, either of these approaches increases the total amount of material, thereby diminishing or even eliminating any advantages achieved by reducing the core density.

It is also possible to reduce the amount of polymer material by using filler material. Closures are known which incorporate fillers into a polymer matrix. For example, U.S. Pat. No. 5,317,047 describes a stopper made of expandable microspheres, cork powder, and a binder such as a polyurethane or acrylic type glue. The preparation method for closures incorporating cork powder in a polyurethane or acrylic matrix generally involves combining the cork powder with polyurethane or acrylic monomers, oligomers, or prepolymers, and polymerizing in situ. However, residual monomers and low molecular weight compounds such as dimers, trimers, and other oligomers, remain in the matrix and/or in the cork powder. These residual monomers and low molecular weight compounds may not be compatible with food safety considerations, since they can migrate into food products which are in contact with the closure. In addition, the methods usually require sustained application of heat over a period of hours in order to set and finish the glue.

It would be advantageous to be able to control the properties of a closure incorporating cork material, in the same way as a closure consisting principally of a single material such as polymer or cork. It would be particularly advantageous to be able to achieve homogeneous properties within such a closure. It would also be advantageous to be able to ensure that the desirable properties for such a closure, for example making it suitable as a closure for a wine bottle, as described herein, are achievable in industrial scale production without significant deviation for individual closures.

In addition to the above, it is often desirable for closures not made of cork to resemble natural cork closures as closely as possible in appearance. Both the longitudinal surface and the flat ends of cylindrical cork closures generally have an irregular appearance, for example showing naturally occurring irregularities in color, structure and profile. The same is true for non-cylindrical cork or cork-type closures, such as closures for champagne bottles. Methods have been developed for providing synthetic closures with a physical appearance similar to natural cork, for example by blending colors to produce a streaking effect in the outer portion of the closure, along the cylindrical axis, or to provide the flat terminating ends of a synthetic closure with a physical appearance similar to natural cork. At the same time, it would be desirable for closures to resemble in its outer appearance cork closures that are made in a single piece from cork such as premium corks. This applies not only to purely synthetic closures, but to all types of closures including, but not limited to composite closures containing cork particles. Closures with an outer appearance made in a single piece from natural cork have the greatest customer acceptance.

The cork industry generates large quantities of by-products, for example cork dust, cork powder, and cork pieces, that are often considered waste products. It would be advantageous to transform these by-products into a high value composite product. It is known to incorporate cork materials into composites with polymers. The incorporation of cork particles into a polymer matrix can, however, be detrimental to the processing and performance properties thereof. Composites comprising large amounts of cork particles, for example more than about 50 wt. % cork particles, based on the total weight of the composite, tend to have properties such as hardness, density and permeability which make them unsuitable as closures for wine bottles. Crosslinkers and/or compatibilizers are often indicated in order to improve properties. However, crosslinkers and/or compatibilizers can raise issues of food safety when used in products which come into contact with foodstuffs. Moreover, cork can contain and release substances that affect the sensory perception of food when used in bulk or in composites as packaging material. Examples of such substances are sensory constituents such as haloanisoles, in particular, but not exclusively, trichloroanisole (TCA). In addition, a closure containing the cork should have good mechanical properties. It would be advantageous for a closure to overcome these problems as far as possible.

Production methods for composite closures comprising cork have so far been limited largely to moulding methods, in particular reactive moulding methods, where cork is combined with monomer or pre-polymer units which are then polymerized in situ in a mould, compression moulding methods, or a combination of compression moulding and reactive moulding methods, largely because of the difficulties often associated with moulding and extrusion methods that use thermoplastic polymers. These difficulties can include achieving a sufficient degree of foaming and/or a sufficient uniformity of foaming and thus a desired low and uniform polymer foam density, as well as achieving a homogeneous distribution of cork particles. It can also be difficult to obtain a cylindrical extrudate with a smooth polymer surface which is not subject to surface melt fracture or undesired surface roughness. If increasing amounts of cork are incorporated, any difficulties and disadvantages in processing and performance are exacerbated. Composites comprising large amounts of smaller particles, for example cork powder, such as more than about 50 wt. % of cork powder, based on the total weight of the composite, tend to have properties such as hardness, density and permeability which make them unsuitable as closures for wine bottles. Crosslinkers are often required in order to improve properties. However, crosslinkers can raise issues of food safety when used in products which come into contact with foodstuffs. Composites comprising larger particles, for example cork granules, can have the disadvantage that the cork granules in the matrix contribute to, or even dominate, the mechanical and permeability properties of the composite, with one result being that these properties are not uniform throughout the composite. In order to be usable as closures for wine bottles, substantially uniform properties throughout the closure are desirable.

Closures incorporating cork material in a synthetic matrix have been previously described. For example, FR 2 799 183 describes synthetic closures consisting of a mixture of cork granulate and cork powder in a polyurethane matrix. The mixture of cork granulate and cork powder is said to be necessary for the homogeneity of the closure. However, the properties of such closures are generally not homogeneous throughout because of the presence of different "zones" comprising either cork or polyurethane. This can be difficult to avoid in moulding processes because of the inherent lack of mixing of components within the mould. This is exacerbated by the fact that coating of cork particles with glue is done by mixing the components at low shear rates and low temperatures. These conditions are necessary in order not to cure the glue prematurely. However, these conditions lead to poor mixing and can create clusters of cork or glue. Furthermore, such closures can crumble and even fall apart because of weaknesses in the matrix arising from the incorporation of larger cork granules and/or the presence of clusters of cork particles which are to a certain extent devoid of binder. It would be advantageous to be able to mix at high shear and/or high temperature which is something which could not be done with glue because it would cure the glue prematurely. High-shear mixing is better than low-shear mixing to provide a good homogeneous blend of particles in the polymer.

Furthermore, it can be more difficult to remove haloanisoles, in particular trichloroanisole (TCA) and other anisoles that can cause organoleptic problems, such as tribromoanisole (TBA), tetrachloroanisole (TeCA) and pentachloroanisole (PCA), from larger pieces of cork, such as cork granules compared to cork powder, so that closures including such larger cork granules might risk the problem of so-called cork taint to a greater extent than those including cork powder. This can, however, be largely or entirely overcome by suitable cleaning methods. As the ease of cleaning is expected to increase with smaller particle sizes, it still remains easier to remove organoleptically active substances from cork granules than from traditional closures made from a single piece of natural cork.

For these reasons, it would be advantageous to be able to produce closures comprising pieces of natural cork, in particular cork particles, wherein the cork particles are embedded in a polymer matrix, which do not suffer from the problems of either natural corks or known cork-polymer composite closures. It would further be advantageous for these closures to resemble in its outer appearance a closure made from a single piece of cork.

In addition to the above, it is also desirable for environmental reasons that closures made from alternative materials such as polymers, be biodegradable, recyclable, compostable, or derived from renewable resources, to the greatest extent possible. Biodegradability and compostability can be measured by standard test methods such as, for example, DIN EN 13432 or ASTM D6400, and in compliance with relevant EU and USA legislation and guidelines, or, for example, the Japanese GreenPla standard for compostable and biodegradable polymers. Biodegradable, recyclable and compostable objects can be, but need not be, made entirely from non-fossil resources. In fact, in addition to polymers derived from natural or renewable sources, which can be synthetic or natural polymers, there are also available polymers made from fossil resources that can be metabolized, for example by microorganisms, due to their chemical structure. Some polyesters, such as poly(caprolactone) or poly(butylenadipate-co-terephthalate), are made from fossil resources and yet are biodegradable.

It is, furthermore, often desirable to provide decorative indicia such as letters and ornaments on the surface of wine stoppers, such as the crest or emblem of a winery. Natural corks are generally marked by a method commonly referred to as "fire branding," i.e., by the application of a hot branding tool. Alternatively, natural corks may also be branded or printed by application of colors or dyes.

It is also known to brand synthetic closures. These closures are commonly branded by means of inkjet or offset printing using special dyes or colors approved for direct or indirect food contact. In case such colors and dyes that are not approved for direct food contact are employed, marking of closures with these colors or dyes is generally only effected on the curved cylindrical surface—the peripheral or lateral surface—of the closure that is not in direct contact with the wine. Such marking can be on the outermost surface, or on an inner surface which is subsequently covered with an outer, preferably at least partially transparent, layer. Marking on the flat terminating surfaces of closures made from alternative materials such as polymers is generally better known for injection molded closures, where marking is effected during the molding process of the closure by providing raised portions on the flat terminating surfaces.

Methods are available for marking the flat terminating surface of closures from alternative materials such as polymers. Laser marking may, in theory, be a feasible method since it allows the avoidance of direct food contact. This method can allow in line printing, for example of closures that have been manufactured by means of extrusion. A further method involves the application of an ornamental layer, in particular an ornamental polymer layer, to a flat terminating surface, by means of heat and/or pressure transfer. This method allows for permanent branding of synthetic closures without giving rise to concerns relating to food safety and without negatively impacting the gas permeation and/or mechanical properties of synthetic closures, in particular of co-extruded synthetic closures.

Research so far aimed mostly at providing barrier layers for closures. Thus, WO 96/28378 A1 describes a closure for a container having an opening, comprising a mass of cork wholly or partially encapsulated in at least one durable, liquid-impermeable coat of a coating material(s) so as to isolate any taint-producing agents present in the mass of cork from the contents of the container. Similarly, U.S. Pat. No. 7,993,743 B2 describes a stopper, particularly for a wine bottle, comprising a barrier layer comprising a hot melt polymeric adhesive and optionally at least one sub-layer having lower oxygen permeability than the hot melt adhesive. WO 0064649 A1 describes a method for producing a coating or diffusion layer on a substrate for use in contact with a food product or beverage, said coating or diffusion layer preventing or inhibiting passage therethrough of flavor-active or odor-active compounds and said method comprising applying to the surface of said substrate an effective amount of a copolymer comprising flexible component and a retentive component.

It is possible that closures with a high proportion of synthetic material are not allowed to be used for certain type of wines which have described natural cork as the choice of closure material. According to European Union Council of Europe Resolution ResAP(2004)2 on cork stoppers and other cork materials and articles intended to come into contact with foodstuffs, for example, a closure may be defined as a cork closure if it includes a minimum of 51% w/w cork. The inclusion of 51% w/w cork in a closure can thus be advantageous in opening up a wider market for its use. In contrast to natural cork closures, synthetic closures often cannot be reinserted into a bottle, or only with some difficulty, once they have been removed. It would therefore be advantageous to provide a closure, having a synthetic component, that can be reinserted into a bottle once it has been removed.

Therefore, there exists a need for a closure or stopper which particularly comprises at least one of the characteristic features described above, said closure or stopper preferably having a physical appearance and/or tactile characteristics similar in at least one aspect to a natural cork closure, said closure resembling in its outer appearance closures made from a single piece of cork, said closure preferably being biodegradable, particularly with only minimal impairment, particularly with no impairment or even with improvement of the other properties of the closure such as, inter alia, OTR, leakage, ease of insertion and removal, compressibility and compression recovery, and/or compatibility with food products.

Other and more specific needs will in part be apparent and will in part appear hereinafter.

SUMMARY

In accordance with one aspect of the present disclosure, a closure for being inserted and securely retained in a portal-forming neck of a container as described in claim 1 is provided. Claims 2 to 57 describe different preferred embodiments of the closure of the present disclosure.

According to another aspect of the present disclosure, a method for applying a decorative layer on a closure precursor to yield a closure for a container as described in claim 58 is provided. Claims 58 to 72 describe preferred embodiments of this method.

According to another aspect of the present disclosure, the use of a closure according to the present disclosure for sealing a container as described in claim 73 is provided.

For completeness, the manufacturing method of a preferred closure precursor is also described herein. Further, the use of a thermoplastic material in the production of a coated particles, said coated particles comprising (1) a core comprising cork material and (2) at least one outer shell comprising thermoplastic material is described herein. The coated particles thus produced may be utilized, for example, in the production of closure precursors for closures according to the invention.

According to yet another aspect of the present disclosure, the use of a thermoplastic material in a method of manufacturing a closure for a product-retaining container constructed for being inserted and securely retained in a portal-forming neck of said container is described.

According to yet another aspect of the present disclosure, the use of a thermoplastic material in a method of manufacturing a closure for a product-retaining container constructed for being inserted and securely retained in a portal-forming neck of said container is described.

The content of the appended claims is part of the present disclosure and description. The content of the appended claims, wholly or partially, can stand on its own or it can be read together and/or combined with the further description provided hereinbelow.

The closure of the present disclosure may be employed as a bottle closure or stopper for any desired product. However, for the reasons detailed above, wine products impose the most burdensome standards on a bottle closure. Consequently, in order to demonstrate the universal applicability of the closure of the present invention, the following disclosure focuses on the applicability and usability of the closure of the present invention as a closure or stopper for wine containing bottles. This discussion is for exemplary purposes only and is not intended as a limitation of the present disclosure.

As discussed above, a bottle closure or stopper for wine must be capable of performing numerous separate and distinct functions. One principal function is the ability to withstand the pressure build up due to temperature variations during storage, as well as prevent any seepage or leakage of the wine from the bottle. Furthermore, a tight seal must also be established to prevent unwanted gas exchange between ambient conditions and the bottle interior, so as to prevent any unwanted oxidation or permeation of gases from the wine to the atmosphere. In addition, the unique corking procedures employed in the wine industry impart substantial restrictions on the bottle closure, requiring a bottle closure which is highly compressible, has high immediate compression recovery capabilities and can resist any deleterious effects caused by the clamping jaws of the bottle closure equipment. In view of environmental considerations, it would be an advantage to be able to provide a closure that is at least partially biodegradable, compostable or recyclable. The tactile properties and/or the physical appearance should preferably be similar to a natural cork closure. Preferably, the closure should resemble a closure made from a single piece of cork in its outer appearance. The contained product should not be spoiled by the closure. Additionally, it would be advantageous for a closure to be easily extractable and reinsertable. A further advantage would be to have print or brand on the closure as if it were a cork closure.

Although prior art products have been produced in an attempt to satisfy the need for alternative bottle closures employable in the wine industry, such prior art systems have often been found lacking in one or more of the generally desirable aspects of a bottle closure for wine products. However, by employing the present disclosure, many of the prior art disadvantages have been reduced or even obviated and an effective, easily employed, mass-produced closure has been realized.

In the present disclosure, many of the prior art disadvantages can be reduced or even overcome by achieving a closure for a product-retaining container constructed for being inserted and securely retained in a portal forming neck of said container, wherein the closure comprises a closure precursor, wherein the lateral surface and the flat terminating surfaces of the closure precursor have a substantially uniform color, and a decorative layer, as well as a method for applying a decorative layer on a closure precursor. Due to the decorative layer, the closure preferably has the outer appearance of a closure made from a single piece of cork.

In accordance with the present disclosure, a closure for a product-retaining container is provided, the closure having a substantially cylindrical shape and comprising substantially flat terminating surfaces forming the opposed ends of the closure, wherein the closure further comprises (a) a closure precursor having a substantially cylindrical shape and comprising a lateral surface and substantially flat terminating surfaces forming the opposed ends of the closure precursor, wherein the lateral surface and the flat terminating surfaces of the closure precursor have a substantially uniform color; and (b) a decorative layer that at least partially covers at least the lateral surface of the closure precursor.

The closure according to the invention thus comprises a closure precursor comprising a lateral surface and a decorative layer applied at least on the lateral surface of the closure precursor. Non-limiting examples of the closure precursor include a synthetic closure, a composite closure, a cork particle agglomerate closure or a closure made from a single piece of cork. The closure precursor and/or the closure according to the invention may comprise thermoset polymers including polyurethane and/or adhesives including reactive and non-reactive adhesives, such as is the case with some cork particle agglomerate closures. However, it is preferred that the closure precursor and/or the closure according to the invention is free of thermoset polymers including polyurethane and/or substantially free of adhesives including reactive and non-reactive adhesives. The closure may comprise one or more further layers, such as an ornamental layer that in particular may comprise indicia such as a logo or a crest of a winery. If the closure precursor is free from synthetic polymers or comprises at least one biodegradable polymer, the closures of the invention can be biodegradable, or at least a part of the closure content can be biodegradable. Desirable closure properties such as oxygen permeability, compressibility and recovery capabilities may be largely unaltered or even improved compared to traditional cork closures. The closure also has good sealing properties. At the same time, the extraction force required to remove the closure from the bottle may not be altered substantially. The closure can more easily be reinserted into a bottle after opening. In addition, the closure resembles in its outer appearance that of a natural cork closure made from a single piece of cork. Furthermore, the tactile properties of the closure may be very similar to a closure from natural cork.

The closure manufactured according to any of the methods described herein will be referred to by terms such as "the closure of the present invention", "the closure of the present disclosure" or "the closure". The phrases "according to the present disclosure" and "according to the present invention" are used synonymously herein. Furthermore, whatever is written herein about the first plastic material applies likewise also to the second plastic material, and vice versa.

The closure of the invention has a substantially cylindrical shape. A cylindrical closure comprises a substantially cylindrical peripheral surface and two substantially flat terminating faces at the opposing ends of the cylindrical shape. The shape may also be referred to as the form herein. This form is well known to the skilled person. The ends of the inventive closure can be beveled or chamfered, as is known from the prior art. Although any desired bevel or chamfered configuration can be employed, such as a radius, curve, or flat surface, it has been found that merely cutting the terminating ends at the intersection with the longitudinal cylindrical surface of the elongated length of material at an angle in the range of from about 30° to about 75°, for example in the range of from about 35° to about 70°, particularly in the range of from about 40° to about 65°, allows formation of a closure which is easier to insert into the neck of a container. Angles of about 45°, 46°, 47°, 48°, 49°, 50°, 51°, 52°, 53°, 54°, 55°, 56°, 57°, 58°, 59° or 60° have been found particularly to contribute to the present disclosure. The bevel or chamfer angle is measured relative to the longitudinal axis of the cylindrical closure. The chamfer angle for a closure for a still wine bottle is particularly within the above ranges, particularly with a chamfer length in the range of from about 0.4 mm to about 2.5 mm, particularly in the range of from about 0.5 mm to about 2.0 mm. Closures for sparkling wine bottles advantageously have a chamfer in the above range, but generally have a deeper and/or longer chamfer than closures for still wine bottles, for example having a chamfer angle in the range of from about 35° to about 55°, particularly in the range of from about 40° to about 50°, more particularly a chamfer angle of about 40°, 41°, 42°, 43°, 44°, 45°, 46°, 47°, 48°, 49° or 50°, and/or a chamfer length in the range of from about 3 mm to about 8 mm, particularly in the range of from about 4 mm to about 7 mm, particularly a chamfer length of about 3 mm, 4 mm, 5 mm, 6 mm, 7 mm or 8 mm. In addition, an end cap can be attached to one or both of said flat terminating surfaces of the closure. Said end cap can be made from any material, preferably from a plastic material. Preferably, the end cap has a circular cross-section with a diameter larger than the diameter of the closure.

The closure of the invention comprises a closure precursor. The details mentioned herein concerning the shape and/or the construction of the closure likewise also apply to the closure precursor, and vice versa. In particular, the closure precursor has a substantially cylindrical shape. A cylindrical closure precursor comprises a lateral surface that is preferably made up from the substantially cylindrical peripheral surface of the closure precursor and two substantially flat terminating faces at the opposing ends of the cylindrical shape.

The lateral surface and the flat terminating surfaces of the closure precursor have a substantially uniform color. Different colors may be used as the uniform color of the lateral surface and the flat terminating surfaces of the closure precursor. Preferably the uniform color is a color on which print can be applied with large flexibility, in particular a light color. In this way, the closure precursor is a clear canvas on which a decorative layer can be applied with large flexibility. Preferably, the uniform color of the surface of the closure precursor is selected from the group consisting of white, yellow, orange, ocher, and mixtures thereof, in particular from the group consisting of RAL 9001, RAL 9010, RAL 1000, RAL 1001, RAL 1002, RAL 1014, RAL 1015, RAL 8001, and mixtures thereof. More preferably, the uniform color of the surface of the closure precursor is selected from the group consisting of RAL 9001, RAL 9010, RAL 1000, RAL 1015, and mixtures thereof. A closure precursor wherein the lateral surface and the flat terminating surfaces have an aforementioned uniform color provide a clear canvas on which a decorative layer can be applied, in particular printed, with large flexibility.

The decorative layer on the closure precursor may cover different parts of the surface of the closure precursor. The decorative layer may cover the lateral surface of the closure precursor at least partly or entirely, preferably entirely. The decorative layer may also cover the flat terminating surfaces of the closure precursor. The flat terminating surfaces of the closure precursor may thereby be coated at least partly or entirely, preferably entirely. Advantageously, the decorative layer covers the lateral surface and the flat terminating surfaces of the closure precursor entirely. In this way, closures that have an outer appearance that resembles a cork closure from single piece of cork from every viewing angle can be obtained.

The decorative layer of the closure precursor preferably comprises a pigment or dye.

Different methods are available to apply the decorative layer onto the closure precursor. For example, the decorative layer may be applied by printing, in particular by offset printing, pad printing, screen printing, inkjet printing, fire branding, or laser printing. Preferably, the decorative layer is applied by pad printing. Printing has the advantage that the desired content can be applied onto the surface with good resolution and/or with a large versatility. Printed decorative layers are also very thin. In particular, the decorative layer may have a thickness of less than 0.1 mm, in particular less than 0.01 mm.

The decorative layer preferably provides the closure with a look very similar to an outer appearance that resembles a cork closure from a single piece of cork. For this purpose, the decorative layer preferably has a high print resolution. Advantageously, the decorative layer has a print resolution of 25 dots per inch (dpi) or more, preferably 72 dpi or more, even preferably 150 dpi or more, more preferably 300 dpi or more, and more preferably 600 dpi or more. A decorative layer with a print resolution in these ranges may contain a very sharp print.

Further, the decorative layer may be monochromatic or polychromatic. A monochromatic decorative layer contains one color, a polychromatic decorative layer contains two or more colors. Preferably, the decorative layer is polychromatic. Each color may comprise several shades. A shade is in particular obtained by adding varying amounts of black to a certain hue. Preferably, the decorative layer comprises one or more shades of at least a single color. Even more preferably, the decorative layer comprises one or more shades of two or more colors. A polychromatic decorative layer comprising one or more, in particular two or more, shades of two or more colors, may have a photorealistic outer appearance that may in particular resemble a closure made from a single piece of cork.

Preferably the decorative layer has photographic image quality. Such a decorative layer particularly has a photorealistic outer appearance that may in particular resemble a closure made from a single piece of cork. In particular, the sharpness, the tone reproduction, and/or the contrast of the decorative layer are of photographic image quality.

The materials used for the decorative layer preferably consist of one or more materials that are compliant or approved as food contact substances (FCS) by the U.S. Food and Drug Administration (FDA) or the European Union (EU). Application of these materials ensures that the closure may safely contact the product in the product retaining container, if the product is a foodstuff, for example wine. It is then also unproblematic when the decorative layer covers the flat terminating surfaces of the closure precursor.

The decorative layer can depict a first indicia. The first indicia comprises preferably one or more selected from the group consisting of letters, symbols, colors, graphics, icons, logos, wood tones, natural cork look, and photographs. Most preferably, the first indicia comprises natural cork look or a photograph. The photograph may show different subjects. Advantageously, the photograph is a photograph of the surface of a cork closure made from a single piece of cork. However, the decorative layer may also comprise letters and symbols or graphics such as the name and the logo of a winery.

Preferably, the decorative layer is not a barrier layer. Instead, it is preferred that the decorative layer is a thinly printed layer on top of the closure precursor. Thus, the decorative layer preferably does substantially not influence the oxygen permeability of the closure precursor and/or the closure.

As mentioned already above, the closure may comprise one or more further layers, in particular an ornamental layer. Preferably, the ornamental layer is on top of the decorative layer. In manufacturing the closure according to the invention, the ornamental layer is preferably applied on top of the decorative layer. The ornamental layer may be applied after drying of the decorative layer. The ornamental layer may also be applied when the decorative layer has not dried entirely. Preferably, the ornamental layer is applied after drying of the decorative layer. The details concerning the pigment or dye, the method of application, the materials the decorative layer consists of and the content of the decorative layer likewise also apply to the ornamental layer. Preferably, the ornamental layer depicts letters, symbols, graphics, icons and/or logos, such as the name and the logo or crest of a winery.

As already mentioned above, different closure precursors can be used in the present invention. For example, the closure precursor may be a synthetic closure precursor and/or comprise a thermoplastic polymer. In the following, several preferred embodiments of closure precursors that can be used in the present invention are described as non-limiting examples.

The closure precursor may have a construction comprising a single component. This component may be referred to as the closure precursor or as a core member. If the closure precursor comprises more than one component, it may be referred to as a multi-component closure precursor or a multi-layer closure precursor. A multi-component closure precursor preferably has a construction comprising a core member, which corresponds to the closure precursor or the core member of the single-component closure precursor, and additionally one or more peripheral layers at least partially surrounding and intimately bonded to the peripheral surface of the core member. According to this embodiment of the disclosure, the closure precursor comprises a) a substantially cylindrically shaped core member comprising at least one thermoplastic polymer, wherein the core member comprises terminating end surfaces forming the opposed ends of the cylindrically shaped core member, and b) at least one peripheral layer at least partially surrounding and intimately bonded to the cylindrical surface of the core member with the end surfaces of the core member being devoid of the peripheral layer, the peripheral layer comprising at least one thermoplastic polymer and a lateral layer surface In this embodiment, the lateral surface of the closure precursor is formed by the lateral layer surface and the substantially flat terminating surfaces forming the opposed ends of the closure precursor are substantially formed by the terminating end surfaces of the core member. An alternative type of closure precursor comprising plural components can comprise a construction such that a core member as described herein is provided with a disc, for example a disc made from natural cork, at one or both flat terminating ends. The disc or discs, if present, completely cover one or both of the terminating ends of the closure precursor.

In the present disclosure, the disclosure relating to a "core member" is intended to mean a single component closure precursor and/or a core member of a multi-component closure precursor. References herein to a "closure precursor" encompass single component closure precursors and multi-component closure precursors, as well as core members of multi-component closure precursors, because core members of multi-component closure precursors and single component closure precursors are generally identical in the presently disclosed closure precursors, having the same composition and the same properties and characteristics, and generally being formed in the same way. Any details herein regarding a core member thus apply to a single component closure precursor, and any details herein regarding a closure precursor or a single component closure precursor likewise apply to a core member. In particular, any reference herein to a core member applies to the entirety of a single component closure precursor. References to the "plastic material" are generally intended to mean the plastic material of the core member, or of a single component closure precursor if the single component closure precursor contains a plastic material, although the disclosure relating to plastic material can also apply to the material of a peripheral layer. Where indicated herein, the details regarding the plastic material can also apply to a peripheral layer, if present.

The closure and/or the closure precursor or the core member used in the present invention preferably comprises a plurality of cells. In particular the plastic material preferably comprises a plurality of cells. In particular the plastic material preferably comprises a polymer matrix comprising a plurality of cells. Preferably the plastic material forms a polymer matrix comprising a plurality of cells. Natural cork comprises a plurality of cells. A plurality of cells is thus already comprised in cork or cork particles. A plurality of cells according to the invention is preferably also comprised in the plastic material. A plurality of cells can be comprised, for example, in a foamed plastic material, also referred to as a foam, as a foam polymer, as a foam plastic material, as a plastic foam, as a polymer foam, as a foamed polymer, as a foamed polymer material, or as a foamed plastic. The plastic material is preferably in the form of a foam. The closure precursor according to the present disclosure particularly comprises at least one foamed plastic material. Preferably, the core member is foamed. The foamed plastic material preferably forms a polymer matrix comprising a plurality of cells. The polymer matrix preferably forms a continuous phase in which a plurality of cork particles (or a plurality of coated particles as defined herein) is embedded if the closure precursor comprises cork or cork particles. A peripheral layer, if present, can also comprise a plurality of cells, for example in the form of an at least partially foamed material. A peripheral layer, if present, may be formed with a substantially greater density than the core material, in order to impart desired physical characteristics to the bottle closure of the present disclosure. According to an exemplary aspect of the present disclosure, the core member is foamed and at least one peripheral layer, if a peripheral layer is present, is substantially not foamed, particularly not foamed. It is also conceivable for a peripheral layer, if present, to be foamed. A peripheral layer may be foamed in the same way as the core member, or to a lesser extent, for example by means of a smaller amount of foaming agent or expandable microspheres in the peripheral layer, for example to make it more flexible. However, a peripheral layer, if present, advantageously has a higher density than the core member.

It is preferred that the plurality of cells comprised in the closure precursor or in the core member is a plurality of substantially closed cells, in particular is a plurality of closed cells. The cells comprised in natural cork are closed cells or substantially closed cells. It is particularly preferred that the plurality of cells comprised in the plastic material is a plurality of substantially closed cells, in particular a plurality of closed cells. In particular it is preferred that the plastic material comprises a polymer matrix comprising a plurality of cells, and the plurality of cells in the polymer matrix is a plurality of substantially closed cells, in particular a plurality of closed cells. By "substantially closed cells" is meant that while the great majority, for example more than 90%, preferably more than 95%, preferably more than 99% of the cells in the plurality of cells are closed cells, some of the cells in the plurality of cells, for example up to 10%, preferably less than 5%, preferably less than 1%, may be open cells. The plurality of cells of the disclosed closure is thus further advantageously defined as being a plurality of substantially closed cells, or that the foam is a substantially closed cell foam. Closed cell foams are generally defined as comprising cells, also referred to as pores, which are substantially not interconnected with each other. Closed cell foams have higher dimensional stability, lower moisture absorption coefficients, and higher strength compared to open-cell-structured foams. A foamed peripheral layer, if present, preferably comprises substantially closed cells.

The plurality of cells, in particular the plurality of cells comprised in the plastic material, preferably has an average cell size in a range of from about 0.025 mm to about 0.5 mm, in particular from about 0.05 mm to about 0.35 mm. Average cell sizes in the plastic material can also be from about 0.05 mm to about 0.3 mm, from about 0.075 mm to about 0.25 mm, preferably from about 0.1 mm to about 0.25 mm, preferably from about 0.1 mm to about 0.2 mm. The average cell size is measured according to standard test methods known to the skilled person, preferably by means of microscopy.

In order to ensure that the core member or the closure precursor possesses inherent consistency, stability, functionality and capability of providing long-term performance, the cell size and/or cell distribution of the plurality of cells is preferably substantially homogeneous throughout the entire length and diameter of the core member or the closure precursor, in particular throughout the entire plastic material. In this way closure precursors and core members with substantially uniform properties, such as, for example OTR, compressibility and compression recovery, can be provided. It is preferred that at least one of the size or the distribution of the plurality of cells in the closure precursor or in the core member is substantially uniform throughout at least one of the length and the diameter of the closure precursor. Particularly preferably, at least one of the size and the distribution of the plurality of cells comprised in the foam plastic material is substantially uniform throughout at least one of the length and the diameter of the closure precursor or the core member, preferably throughout the plastic material comprised in the closure precursor or the core member. Such uniformity contributes to the homogeneity of the closure precursor or the core member, in respect of both structural stability and performance properties. It also contributes to a homogeneous distribution of cork particles (or coated particles) throughout the closure precursor or the core member, by providing a uniformly supporting polymer matrix and avoiding clustering or clumping together of cork particles (or coated particles), which could be caused, for example by localized weak spots in the polymer matrix.

In another exemplary aspect of the present disclosure, the core member or the closure precursor, in particular the plastic material, comprises closed cells having at least one of an average cell size ranging from about 0.02 millimeters to about 0.50 millimeters and a cell density ranging from about 8,000 cells/$cm^3$ to about 25,000,000 cells/$cm^3$. Although this cell configuration has been found to produce a highly effective product, it has been found that even more advantageous products are those wherein said core member comprises closed cells having at least one of an average cell size ranging from about 0.05 mm to about 0.1 mm and a cell density ranging from about 1,000,000 cells/$cm^3$ to about 8,000,000 cells/$cm^3$. According to one embodiment, cork particles forming the core of coated particles as defined herein, have an average cell size in the range of from 0.02 mm to 0.05 mm and a cell density in the range of from $4\times10^7$ to $20\times10^7$ cells/$cm^3$. Preferably the plastic material has average cell size in a range of from about 0.025 mm to about 0.5 mm, in particular in the range of from about 0.05 mm to about 0.35 mm, preferably in the range of from about 0.05 mm to about 0.3 mm, preferably in the range of from about 0.075 mm to about 0.25 mm, preferably in the range of from about 0.1 mm to about 0.25 mm, preferably in the range of from about 0.1 mm to about 0.2 mm and a cell density in the range of from $1.8\times10^6$ to $5\times10^6$ cells/cm$^3$.

The closure precursor used in the present invention can be formed, for example, by means of extrusion or moulding. In known closures or closure precursors formed from thermoplastic polymers by means of extrusion or moulding, the synthetic component, or the polymer, can be foamed by means of a blowing agent, also referred to as a foaming agent. It is well known in the industry to employ a blowing agent in forming plastic material, for example extruded or moulded foam plastic material, such as is advantageous for the closure precursor. In the present disclosure, a variety of blowing agents can optionally be employed during the manufacturing process to produce the closure precursor. Typically, either physical blowing agents or chemical blowing agents, or a combination of physical and chemical blowing agents, are employed. Expandable microspheres can also be used. The blowing agent that may be used in formation of the closure precursor can be selected, for example, from the group consisting of expandable microspheres, chemical blowing agents, physical blowing agents, and combinations of two or more thereof. Particularly preferably, the blowing agent comprises or is expandable microspheres.

Chemical blowing agents include azodicarbonamic, azodicarbonamide, azodiisobutyro-nitride, benzenesulfonhydrazide, 4,4-oxybenzene sulfonylsemicarbazide, p-toluene sulfonylsemicarbazide, barium azodicarboxlyate, N,N'-Dimethyl-N,N'-dinitrosoterephthalamide, and trihydrazinotriazine. An example of a suitable chemical blowing agent is sold by Clariant International Ltd, BU Masterbatches (Rothausstr. 61, 4132 Muttenz, Switzerland) under the trade name Hydrocerol®.

Alternatively, or in addition to, a chemical blowing agent, it is possible for an inorganic, or physical, blowing agent to be used in making the closure precursor according to the present disclosure. Examples of physical blowing agents include carbon dioxide, water, air, helium, nitrogen, argon, and mixtures thereof. Carbon dioxide and nitrogen are particularly useful blowing agents.

Suitable physical blowing agents that have been found to be efficacious in producing the closure precursor of the present disclosure can comprise one or more selected from the group consisting of: aliphatic hydrocarbons having 1-9 carbon atoms, halogenated aliphatic hydrocarbons having 1-9 carbon atoms and aliphatic alcohols having 1-3 carbon atoms. Aliphatic hydrocarbons include methane, ethane, propane, n-butane, isobutane, n-pentane, isopentane, neopentane, and the like. Among halogenated hydrocarbons and fluorinated hydrocarbons they include, for example, methylfluoride, perfluoromethane, ethyl fluoride, 1,1-difluoroethane (HFC-152a), 1,1,1-trifluoroethane (HFC-430a), 1,1,1,2-tetrafluoroethane (HFC-134a), pentafluoroethane, perfluoroethane, 2,2-difluoropropane, 1,1,1-trifluoropropane, perfluoropropane, perfluorobutane, perfluorocyclobutane. Partially hydrogenated chlorocarbon and chlorofluorocarbons for use in this disclosure include methyl chloride, methylene chloride, ethyl chloride, 1,1,1-trichlorethane, 1,1-dichloro-1-fluoroethane (HCFC-141b), 1-chloro-1,1-difluoroethane (HCFC-142b), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromethane (CFC11), dichlorodifluoromethane (CFC-12), trichlorotrifluoroethane (CFC-113), dichlorotetrafluoroethane (CFC-114), chloroheptafluoropropane, and dichlorohexafluoropropane. Fully halogenated chlorofluorocarbons are not preferred due to their ozone depletion potential. Aliphatic alcohols include methanol, ethanol, n-propanol and isopropanol.

If a chemical and/or physical blowing agent is employed, in order to control the cell size in the closure, in particular in the plastic material, and attain the desired cell size detailed herein, a nucleating agent is often employed during foaming of the plastic material. Preferred nucleating agents are selected from the group consisting of calcium silicate, talc, clay, titanium oxide, silica, barium sulfate, diatomaceous earth, and mixtures of citric acid and sodium bicarbonate, which enable the desired cell density and cell size to be achieved. In a particular embodiment of the present invention, it has been found that a nucleating agent, such as one of those listed herein, may be employed. Cork particles can also act as nucleating agent.

If a chemical or physical blowing agent is used, or a combination of one or more chemical blowing agents and one or more physical blowing agent, the blowing agent or agents may be incorporated into the plastic material in an amount ranging from about 0 to about 10 wt. %, preferably from about 0.005 wt. % to about 10 wt. %, more preferably from about 0.1 to about 4 wt. %, more preferably from 0.1 to about 2 wt. % based on the total weight of the closure precursor.

In order to achieve the objects of the invention, the plurality of cells is preferably obtained by using expandable microspheres as blowing agent. Expandable microspheres consist of a thin thermoplastic shell, usually made from a copolymer of monomers such as vinylidene chloride, acrylonitrile and/or methyl methacrylate, that encapsulates a low boiling point liquid hydrocarbon blowing agent, typically isobutene or isopentane. When heated, the polymeric shell gradually softens, and the hydrocarbon expands, thereby increasing the internal pressure inside the microsphere and causing the polymeric shell to expand. When the heat is removed, the shell stiffens and the microsphere remains in its expanded form. When fully expanded, the volume of the microspheres can increase by more than 40 times, potentially up to 60 to 80 times. It is believed that in the closure precursors used in the present invention the thermoplastic polymer or polymers of the microsphere shell are fused into the polymer matrix while maintaining the integrity of the microsphere or the expanded microsphere, and thus form at least a part of the cell walls of the plurality of cells in the polymer matrix. The cell walls that define the cells in the plurality of cells and face the interior of the respective cell are believed to comprise predominantly the thermoplastic polymer or polymers of the expandable microspheres' shells. In this way, at least one cell in the plurality of cells comprised in the plastic material is defined by at least one cell wall facing the interior of the cell, the plastic material of at least a part of the cell wall comprising a different thermoplastic polymer composition compared to the plastic material forming the remainder of the polymer matrix. Preferably, the cells in the plurality of cells comprised in the plastic material are defined by cell walls, the plastic material of the cell walls facing the interiors of the cells comprising a different thermoplastic polymer composition compared to the plastic material forming the remainder of the polymer matrix. If thermoplastic expandable microspheres are used, a nucleating agent as described herein need not be employed, preferably is not employed. Particularly preferably a nucleating agent is not added to the composition from which the closure is formed.

Expandable microspheres may be used in the manufacturing of closure precursors used in the present invention in an amount ranging from about 0.005 wt. % to about 10 wt. %, preferably in an amount ranging from about 0.05 wt. % to about 10 wt. %, preferably in an amount ranging from about 0.5 wt. % to about 10 wt. %, preferably in an amount ranging from about 0.1 wt. % to about 5 wt. %, preferably in an amount ranging from about 0.1 wt. % to about 4 wt. %, preferably in an amount ranging from about 1.0 wt. % to about 4 wt. %, preferably in an amount ranging from about 1.5 wt. % to about 3 wt. %, preferably in an amount ranging from about 2 wt. % to about 2.5 wt. % based on the total weight of the composition. Expandable microspheres may be used in combination with one or more blowing agents selected from chemical blowing agents and physical blowing agents, or expandable microspheres may be used as the sole foaming agent, in the absence of one or more blowing agents selected from chemical blowing agents and physical blowing agents. In the absence of a blowing agent such as a chemical blowing agent and/or a physical blowing agent, the cells in the foam are substantially formed from the expandable microspheres. In this case, the amount of expandable microspheres is preferably sufficient to achieve the desired foam density of the plastic material. According to one embodiment of the invention, if expandable microspheres are used as foaming agent in the absence of a chemical or physical blowing agent, a nucleating agent is not used and the composition used to form the closure precursor does not comprise a nucleating agent. According to another embodiment of the invention, if a combination of expandable microspheres with one or more chemical and/or physical blowing agents is used, the composition can comprise a nucleating agent.

The closure according to the invention and/or the closure precursor preferably has an overall density in the range of from 100 kg/m$^3$ to 500 kg/m$^3$, preferably in the range of from about 125 kg/m$^3$ to 500 kg/m$^3$, preferably in the range of from about 150 kg/m$^3$ to 500 kg/m$^3$, preferably in the range of from about 150 kg/m$^3$ to 480 kg/m$^3$, preferably in the range of from about 150 kg/m$^3$ to 450 kg/m$^3$, preferably in the range of from about 175 kg/m$^3$ to 450 kg/m$^3$, or in the range of from about 200 kg/m$^3$ to 420 kg/m$^3$, or in the range of from about 200 kg/m$^3$ to 400 kg/m$^3$. The overall density takes into account the density of the cork particles, which is generally in the range of from about 150 kg/m$^3$ to 280 kg/m$^3$, typically in the range of from about 180 kg/m$^3$ to 280 kg/m$^3$, often about 180 kg/m$^3$. The plastic material preferably has a density in the range of from about 25 kg/m$^3$ to 800 kg/m$^3$, preferably in the range of from about 50 kg/m$^3$ to 800 kg/m$^3$, preferably in the range of from about 75 kg/m$^3$ to 800 kg/m$^3$, preferably in the range of from about 100 kg/m$^3$ to 800 kg/m$^3$, preferably in the range of from about 150 kg/m$^3$ to 700 kg/m$^3$, preferably in the range of from about 150 kg/m$^3$ to 600 kg/m$^3$, preferably in the range of from about 150 kg/m$^3$ to 500 kg/m$^3$, preferably in the range of from about 180 kg/m$^3$ to 500 kg/m$^3$, or in the range of from about 200 kg/m$^3$ to 450 kg/m$^3$, preferably in the range of from about 200 kg/m$^3$ to 420 kg/m$^3$. These density ranges allow the closure to attain desired closure properties as disclosed herein.

The closure precursor may comprise cork. According to an embodiment, the closure precursor comprises 1 to 99 wt. %, in particular 5 to 85 wt. % or 20 to 75 wt. % or 30 to 72 wt. % or 33 to 65 wt. % or 33 to 59 wt. % cork, in each case based on the total weight of the closure precursor. It is preferred according to this embodiment that the closure precursor comprises more than 50 wt. % cork, based on the total weight of the closure precursor. Advantageously, the cork is in the form of cork particles.

It has been found that in known closures and methods for production of closures, in particular extrusion methods, achieving a desired, homogeneous foam density using selected chemical and/or physical blowing agents can be detrimentally affected by the presence of large amounts, such as greater than about 40 wt. %, based on the total closure weight, of cork particles (or the coated particles as defined herein). It is believed that the cork particles (or the coated particles as defined herein) may in some way detrimentally affect the formation of a homogeneous foam with a density in the desired range, when using selected conventional chemical or physical blowing agents. While chemical and/or physical blowing agents may be used according to the invention, it has been found that the use of expandable microspheres generally results in a foam having the desirable properties. In an aspect of the present invention, expandable microspheres are used as foaming agent. In this aspect, according to a preferred embodiment of the invention, no additional chemical or physical blowing agent and no added nucleating agent is employed, particularly no additional chemical or physical blowing agent and no added nucleating agent is added to the composition used to form the closure precursor.

One of the difficulties associated with incorporating cork particles (or the coated particles as defined herein) into an extruded or moulded polymer matrix of the sort described herein, particularly in larger amounts, for example where greater than about 40% by weight of cork particles is comprised, is in embedding the particles in the polymer matrix so that a smooth, continuous peripheral surface is achieved, without protruding pieces of cork and without discontinuous or rough areas on the peripheral surface. This is a particular problem with extruded parts, because the peripheral surface of the polymer matrix can catch and drag where it contacts the extrusion equipment, resulting in an uneven surface. While a certain amount of surface roughness can be smoothed by means of sanding, for example as is done with natural cork closures, this adds an additional process step, as well as generating extra waste, which cannot always be recycled but must be disposed of. In addition, if surface roughness increases, any sanding step must remove more material, which can also require that the extrudate includes more material, e.g. a wider diameter, to accommodate the greater amount of sanding. According to an embodiment, the closure and/or the closure precursor contains more than 50 wt. % of cork particles (or the coated particles as defined herein). The cork particles (or the coated particles as defined herein) may form part of the peripheral surface. This can be advantageous inter alia in terms of appearance of the closure. In this case the plurality of particles (or the coated particles as defined herein), and in particular individual particles or groups of particles, preferably do not protrude from the peripheral surface. Accordingly, it is preferred that the closure precursor used in the present invention is cylindrical, or is in the form of a sparkling wine closure, and comprises a peripheral surface, wherein the peripheral surface preferably comprises a smooth surface comprising plastic material and particles comprising cork (or the coated particles as defined herein), or comprises a smooth, continuous surface of plastic material.

Preferably, the closure precursor does not have surface melt fracture, also sometimes referred to as sharkskin. While the exact causes of surface melt fracture are a matter of debate in the scientific literature, it appears that surface melt fracture can occur in extruded polymer melts as a function of extrusion rates, with higher extrusion rates resulting in a greater degree of surface melt fracture. At a lower degree of surface melt fracture, surface irregularities are less pronounced and may appear as surface roughness. Higher degrees of surface melt fracture result in significant surface deformities and fracturing, fissuring or breaking of the extrudate surface, which is not always restricted to the surface but can extend to a significant depth within the extrudate. Such a high degree of deformation would prevent the use of such an extrudate as a closure precursor. Polymer matrices with a high load of cork particles, for example greater than 40 wt. % cork particles, or greater than 50 wt. % cork particles, based on the total weight of the formulation, are susceptible to melt stress fracture. This significantly affects the available window of processing parameters for the production of extruded cylindrical closure precursors containing large amounts of cork particles. The present invention permits the reduction or substantially the elimination of surface melt fracture, while maintaining commercially and technically advantageous production methods and processing parameters.

If a closure precursor comprising cork, in particular cork particles, is used the distribution of the cork particles (or the coated particles as defined herein) in the closure precursor is preferably substantially uniform throughout at least one of the length and the diameter of the closure precursor. This prevents areas of weakness within the closure precursor, for example regions comprising substantially cork particles (or the coated particles as defined herein) without sufficient plastic material to form a supporting matrix, which can result in crumbling and breaking of the closure precursor. This may be achieved by the selection of composition components, in particular the combination of plastic material and pre-coated cork particles ("coated particles") as described herein. The optional use of expandable microspheres as foaming agent according to a preferred embodiment of this invention can also contribute to achieving this advantage, for example by contributing to the formation of a homogeneous, stable cellular polymer matrix that is capable of supporting an even distribution of the cork particles (or the coated particles as defined herein) throughout the matrix. The exact composition used can vary within the parameters and ranges disclosed herein.

The closure precursor used in the invention may be formed by means of moulding, for example injection moulding or compression moulding, particularly compression moulding, or by means of extrusion. Preferably the closure precursor is formed by means of extrusion. Extrusion permits a convenient, reliable, continuous mass production of closure precursors including polymer components.

According to one embodiment, the closure precursor does not comprise a separately formed peripheral layer surrounding and intimately bonded to the cylindrical surface of a core member. If such a separate peripheral layer is not comprised, the closure precursor according to the invention is preferably formed by means of moulding or by means of monoextrusion, preferably by means of monoextrusion. This means that an extrudate having a single component, an elongated cylindrical rod, is formed.

It is possible that the closure precursor comprises one or more peripheral layers peripherally surrounding and intimately bonded to the cylindrical surface of the core member. An optional peripheral layer is preferably intimately bonded to substantially the entire cylindrical surface of the core member, in particular the entire cylindrical surface of a substantially cylindrical core member. The end surfaces of the core member are preferably devoid of the peripheral layer. If any large unbonded areas exist, flow paths for gas and liquid could result. Consequently, secure, intimate, bonded interengagement of at least one peripheral layer with the core member is advantageous for attaining a bottle closure for the wine industry. In order to achieve integral bonded interconnection between the at least one peripheral layer and the core member, the at least one peripheral layer is formed about the core member in a manner which assures intimate bonded engagement.

The closure precursor used in the present disclosure is preferably formed by extrusion. If the closure precursor comprises one or more peripheral layers, these are preferably formed as a separate layer or as separate layers, by means of co-extrusion. Particularly, the desired secure, intimate, bonded, interengagement is attained by simultaneous co-extrusion of the at least one peripheral layer and the core member or by applying the at least one peripheral layer to the continuous, elongated length of material after the continuous, elongated length of material has been formed. By employing either process, intimate bonded interengagement of the at least one peripheral layer to the continuous, elongated length of material is attained.

In a particular aspect of the present disclosure, therefore, the closure precursor can be produced by a process comprising at least a process step of co-extrusion. According to this aspect of the disclosure, the synthetic closure comprises a core member and a peripheral layer, which are formed by co-extrusion. Suitable co-extrusion methods are known to the skilled person.

In one aspect of the present disclosure, comprising a core member and a peripheral layer, said core member and said at least one peripheral layer are extruded substantially simultaneously. In another aspect, the core member is extruded separately and subsequent thereto said at least one peripheral layer is formed in extrusion equipment peripherally surrounding and enveloping the pre-formed core member.

In further aspects, the closure precursor may comprise two or more peripheral layers. It is possible that a first peripheral layer which is in secure, intimate, bonded, interengagement with the outer surface of a core member, particularly with the outer cylindrical surface of a cylindrical core member is formed by either substantially simultaneous extrusion with the core member, or by subsequent extrusion, or by moulding, as described herein. A second peripheral layer and subsequent peripheral layers can then be formed likewise by either substantially simultaneous extrusion with the core member and the first or further peripheral layers, or by subsequent extrusion, as described herein for the first peripheral layer. With multiple peripheral layers it is also possible that two or more peripheral layers are extruded subsequently, as described herein, but substantially simultaneously with each other.

In one embodiment, the closure precursor does not comprise a peripheral layer. This can be preferred, for example with closures for sparkling wine bottles, but can also be preferred with cylindrical closures, for example for still wine bottles. It is an advantage of the present disclosure that even in the absence of a peripheral layer, a closure precursor used in the invention has a sufficiently smooth surface to achieve a closure even if cork particles (or coated particles as defined herein) are comprised to greater than 50 wt. %, for example 51 wt. % or more of the total closure precursor weight.

The closure precursor may comprise a first plastic material. The closure precursor may also comprise a second plastic material. The first and second plastic material may each comprise independently at least one thermoplastic polymer. The first and second plastic materials can be identical or different. The first and second plastic materials can be chosen independently. In other words: The plastic material chosen for the coating of the particles (first plastic material) can be the same as or different from the second material. Whatever is described herein with respect to the "plastic material" can apply both to the first plastic material and/or to the second plastic material. The plastic material can comprise one thermoplastic polymer, or more than one thermoplastic polymer, for example two, three or more thermoplastic polymers. If expandable microspheres are used as foaming agent, the plastic material typically comprises more than one thermoplastic polymer. This is because the thermoplastic polymer or polymers of the microsphere shells remains in the closure precursor. The term "polymer" is intended to include all materials having a polymeric chain composed of many subunits, which may be the same or different, such as, for example, all types of homopolymers and copolymers, including statistical copolymers, random copolymers, graft copolymers, periodic copolymers, block copolymers, any of which may be straight chain or branched. The term "thermoplastic" has its usual meaning in the art.

The closure precursor may comprise 1 to 49 wt. %, in particular 5 to 32 wt. % or 5 to 30 wt. % or 5 to 26 wt. % of a first plastic material, in each case based on the total weight of the closure precursor.

The closure precursor may comprise 10 to 49 wt. %, in particular 12 to 49 wt. % or to 35 wt. % of a second plastic material, in each case based on the total weight of the closure precursor.

According to an embodiment, the second plastic material is a thermoplastic material comprising a polymer elastomer gum, the polymer elastomer gum comprising one or more thermoplastic polymers as defined herein. According to another embodiment, the second plastic material is a thermoplastic material comprising a polymer elastomer dispersion, the polymer elastomer dispersion comprising one or more thermoplastic polymers as defined herein.

According to a preferred aspect of the closure precursor used in the invention, the plastic material is thermoplastically processable. This means that the plastic material of the closure precursor, once formed into the closure precursor, can be re-formed or re-processed thermally, i.e. by applying heat. This is preferably achieved if the plastic material comprises thermoplastic polymer without added crosslinker. It is, however, possible to add small amounts of crosslinker or of some types of glue, such as epoxy glue, for example in order to modify rheology or make polymers compatible, and still retain thermoplastic processabilty. Thermoplastic processability can be advantageous if it is desired to separate parts of the closure such as cork particles, for example in order to recycle or reuse any part of the closure, such as the cork particles or the plastic material or both. While closure precursors comprising thermoset polymers and/or adhesives including reactive and non-reactive adhesives can be used in the present invention, these known non-thermoplastic closures cannot be processed thermally, making it difficult, if not impossible, to separate different components such as cork and polymer and thus separately to recycle or reuse any part of the closure. Thus, a formulation of closure precursors used in the present invention, which allows the formation of the closure precursors by thermoplastic extrusion or moulding methods, contributes to making this possible.

According to one embodiment of the present disclosure, at least one, preferably each thermoplastic polymer comprised in the plastic material optionally is a low-density polymer having an unfoamed density in the range of from 0.7 g/cm$^3$ to 1.4 g/cm$^3$. This aspect can be particularly advantageous if the core member comprises larger amounts of cork particles (or coated particles as defined herein) within the ranges disclosed herein, for example more than 40 wt. %, more than 45 wt. %, more than 50 wt. % and particularly more than 51 wt. % particles. A lower polymer density helps to compensate a possible increase in density of the closure precursor resulting from inclusion of the particles.

In an exemplary aspect according to the present disclosure the closure precursor used in the present disclosure comprises, as its principal component, a core member formed from extruded, foamed plastic material comprising one or more thermoplastic polymers, selected from copolymers, homopolymers, or combinations of any two or more thereof. Although any known thermoplastic polymeric material, particularly any foamable thermoplastic polymeric material can be employed in the closure precursor used in the present disclosure, the plastic material is preferably selected for producing physical properties similar to natural cork, so as to be capable of providing a synthetic closure for replacing natural cork as a closure for wine bottles. By way of example, the plastic material for the core member can be a closed cell foam plastic material.

If the closure precursor comprises one or more peripheral layers, the material of one or more peripheral layers comprises one or more thermoplastic polymers. In an exemplary aspect, the at least one peripheral layer, if comprised, comprises a thermoplastic polymer identical or similar to the thermoplastic polymer comprised in the core member. A peripheral layer can, on the other hand, comprise a thermoplastic polymer which is different to the thermoplastic polymer or thermoplastic polymers comprised in the core member. However, as detailed herein, in either case, irrespective of the polymer or polymers, the physical characteristics imparted to a peripheral layer preferably differ substantially from the physical characteristics of the core member, in particular the peripheral layer density is substantially greater than the core member density. A preferred peripheral layer density is in the range of from 50 kg/m$^3$ to 1500 kg/m$^3$, preferably in the range of from 100 kg/m$^3$ to 1500 kg/m$^3$, preferably in the range of from 200 kg/m$^3$ to 1500 kg/m$^3$, preferably in the range of from 300 kg/m$^3$ to 1500 kg/m$^3$, preferably in the range of from 400 kg/m$^3$ to 1500 kg/m$^3$, preferably in the range of from 500 kg/m$^3$ to 1500 kg/m$^3$, preferably in the range of from 600 kg/m$^3$ to 1500 kg/m$^3$, preferably in the range of from 700 kg/m$^3$ to 1500 kg/m$^3$, preferably in the range of from 750 kg/m$^3$ to 1500 kg/m$^3$, or in the range of from 700 kg/m$^3$ to 1350 kg/m$^3$, or in the range of from 700 kg/m$^3$ to 1100 kg/m$^3$, or in the range of from 750 kg/m$^3$ to 1350 kg/m$^3$, or in the range of from 750 kg/m$^3$ to 1100 kg/m$^3$.

According to a preferred aspect of the closure precursor used in the invention the plastic material comprises one or more polymers that are biodegradable according to ASTM D6400. Preferably, at least 90 wt. %, more preferably at least 95 wt. %, in particular 100% of the plastic material, in particular of the first plastic material, is biodegradable according to ASTM D6400. As cork particles are biodegradable, if the plastic material comprises one or more biodegradable polymers, the majority or the entirety of the closure precursor and/or the closure can be biodegradable. If it is desired for a multi-component closure precursor to be biodegradable, compostable or recyclable, preferably both the plastic material of the core member and the plastic material of the peripheral layer or layers are biodegradable, compostable or recyclable.

Preferably, from 50% by weight to 100% by weight of the closure, preferably from 60% by weight to 100% by weight of the closure precursor, preferably from 70% by weight to 100% by weight of the closure precursor, preferably from 80% by weight to 100% by weight of the closure precursor, preferably from 85% by weight to 100% by weight of the closure precursor, preferably from 85% by weight to 99.9% by weight of the closure precursor, preferably from 90% by weight to 99.9% by weight of the closure precursor, preferably from 90% by weight to 99% by weight of the closure precursor, preferably from 90% by weight to 98% by weight of the closure precursor, in each case based on the entire weight of the closure precursor, including any peripheral layer or layers if present, is biodegradable, as determined, for example, by ASTM D6400. If a chemical or physical blowing agent is used to form the foam plastic material, it can be possible to achieve up to and including about 100% biodegradability of the closure precursor, for example from 90% by weight to 100% by weight of the closure precursor, preferably from 95% by weight to 100% by weight of the closure precursor, preferably from 98% by weight to 100% by weight of the closure precursor, based on the entire weight of the closure precursor, by selecting one or more biodegradable thermoplastic polymers as plastic material. The currently available polymer formulations for the shells of commercial expandable microspheres are not biodegradable. If a closure precursor used in the invention is made using currently available expandable microspheres as foaming agent, the closure precursor will include approximately the same weight percent amount of non-biodegradable polymer as the weight percent amount of the expandable microspheres in the closure precursor, and the biodegradable portion of the closure precursor will be correspondingly decreased by the same amount. Accordingly, if expandable microspheres are employed as foaming agent, the plastic material can comprise up to 10 wt. %, preferably from about 0.005 wt. % to about 10 wt. %, preferably in an amount ranging from about 0.05 wt. % to about 10 wt. %, preferably in an amount ranging from about 0.5 wt. % to about 10 wt. %, preferably in an amount ranging from about 1.0 wt. % to about 10 wt. %, preferably in an amount ranging from about 1.0 wt. % to about 8 wt. %, preferably in an amount ranging from about 1.0 wt. % to about 5 wt. %, preferably in an amount ranging from about 1.0 wt. % to about 4 wt. %, or in an amount ranging from about 1.5 wt. % to about 4.0 wt. %, based on the total weight of the plastic material, of non-biodegradable thermoplastic polymer. Should suitable biodegradable expandable microspheres become available, the amount of biodegradable material in the closure can be increased accordingly.

The plastic material of the closure according to the invention preferably comprises one or more thermoplastic polymers selected from the group consisting of: polyethylenes; metallocene catalyst polyethylenes; polybutanes; polybutylenes; thermoplastic polyurethanes; silicones; vinyl-based resins; thermoplastic elastomers; polyesters; ethylenic acrylic copolymers; ethylene-vinyl-acetate copolymers; ethylene-methyl-acrylate copolymers; thermoplastic polyolefins; thermoplastic vulcanizates; flexible polyolefins; fluorelastomers; fluoropolymers; polytetrafluoroethylenes; ethylene-butyl-acrylate copolymers; ethylene-propylene-rubber; styrene butadiene rubber; styrene butadiene block copolymers; ethylene-ethyl-acrylic copolymers; ionomers; polypropylenes; copolymers of polypropylene and ethylenically unsaturated comonomers copolymerizable therewith; olefin copolymers; olefin block copolymers; cyclic olefin copolymers; styrene ethylene butadiene styrene block copolymers; styrene ethylene butylene styrene block copolymers; styrene ethylene butylene block copolymers; styrene butadiene styrene block copolymers; styrene butadiene block copolymers; styrene isoprene styrene block copolymers; styrene isobutylene block copolymers; styrene isoprene block copolymers; styrene ethylene propylene styrene block copolymers; styrene ethylene propylene block copolymers; polyvinylalcohol; polyvinylbutyral; polyhydroxyalkanoates; copolymers of hydroxyalkanoates and monomers of biodegradable polymers; polylactic acid; copolymers of lactic acid and monomers of biodegradable polymers; aliphatic copolyesters; aromatic-aliphatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly(butylenesuccinate-co-adipate); poly(trimethyleneterephthalate); poly(butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; polymers formed from monomer units selected from vinylidene chloride, acrylonitrile, methacrylonitrile, and methyl methacrylate; copolymers formed from two or more monomer units selected from vinylidene chloride, acrylonitrile and methyl methacrylate; PEF, PTF, bio-based polyesters and combinations of any two or more thereof.

The first plastic material preferably comprises one or more thermoplastic polymers selected from the groups consisting of aliphatic (co)polyesters, aliphatic aromatic copolyesters, EVA, olefinic polymers such as metallocene polyethylene, and styrenic block copolymers.

Thermoplastic polymers for the plastic material may be selected from the group consisting of polyolefins, in particular polyethylenes and/or polypropylenes. If a polyethylene is employed, in an exemplary aspect of the closure precursor disclosed herein the polyethylene can comprise one or more polyethylenes selected from the group consisting of high density, medium density, low density, linear low density, ultra high density, and medium low density polyethylenes. Suitable plastic materials for the closure precursor, or the core element thereof, can be polyethylene, in particular LDPE, and/or ethylene-vinyl-acetate copolymer (EVA). These materials can be used alone or in combination with one or more other thermoplastic polymers disclosed herein, in particular with metallocene PE or metallocene PP, particularly with metallocene PE.

The closure precursor can comprise a cyclic olefin copolymer. Suitable cyclic olefin copolymers, as well as methods for their synthesis and characterization, are described in U.S. Pat. No. 8,063,163 B2, the contents of which in relation thereto are incorporated by reference herein and form a part of the present disclosure. A suitable cyclic olefin copolymer is commercially available under the name Topas® Elastomer E-140 from Topas Advanced Polymers, Germany. A preferred cyclic olefin copolymer is a copolymer of ethylene and norbornene.

Particularly preferred plastic materials are thermoplastic elastomers based on one or more polyesters. Thermoplastic elastomers have both thermoplastic and elastomeric properties and are sometimes also referred to as thermoplastic rubbers. The elastomeric properties can be useful in closure precursors as they can contribute, for example to elasticity, compression recovery, and compressibility, among others.

Elastomers are generally thermosetting and thus not thermoplastically processable. For this reason elastomers generally cannot be recycled. They also cannot be processed thermoplastically, for example by means of extrusion. Thermoplastic elastomers are thermoplastically processable. Thermoplastic elastomers can also be recycled. Thermoplastic elastomers based on polyesters can additionally be biodegradable to a significant degree due to the ester linkages, which are more easily cleaved than other polymer linkage types. Thermoplastic elastomers based on one or more polyamides can also be considered. However, thermoplastic elastomers based on one or more polyesters are preferred. The entire plastic material can be formed from one or more thermoplastic elastomers, or the plastic material can comprise one or more thermoplastic elastomers, in particular one or more thermoplastic elastomers based on one or more polyesters, in an amount of up to 80 wt. %, particularly in an amount in a range of from 2 wt. % to 80 wt. %, particularly in an amount in a range of from 5 wt. % to 80 wt. %, particularly in an amount in a range of from 10 wt. % to 80 wt. %, particularly in an amount in a range of from 15 wt. % to 80 wt. %, particularly in an amount in a range of from 20 wt. % to 80 wt. %, particularly in an amount in a range of from 25 wt. % to 80 wt. %, based on the total weight of the plastic material.

It is advantageous for the closure precursor to be at least partially biodegradable, compostable, recyclable, or to be made using at least a proportion of renewable and/or sustainable materials. If it is desired that the closure precursor should be biodegradable, or biodegradable to greater than 85 wt. %, preferably to greater than 90 wt. %, the plastic material preferably comprises one or more biodegradable thermoplastic polymers. Preferably, the first plastic material independently comprises one or more thermoplastic polymers selected from the groups consisting of aliphatic (co) polyesters and aliphatic aromatic copolyesters. In particular, the plastic material preferably comprises one or more biodegradable thermoplastic polymers selected from the group consisting of polyhydroxyalkanoates; copolymers of hydroxyalkanoates and monomers of biodegradable polymers; polylactic acid; copolymers of lactic acid and monomers of biodegradable polymers; aliphatic copolyesters; aliphatic-aromatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly (butylenesuccinate-co-adipate); poly (trimethyleneterephthalate); poly(butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; and combinations of any two or more thereof. If a polyhydroxyalkanoate (PHA) is comprised, the polyhydroxyalkanoate monomers preferably contain at least four carbon atoms, preferably four or five carbon atoms. Advantageously, the repeat unit of the polyhydroxyalkanoate according to the present disclosure comprises [—O—CHR—$CH_2$—CO—], wherein R is a linear or branched alkyl group with the formula $CnH_{2n+1}$ with n being an integer from 1 to 15, particularly from 1 to 6. If a PHA is employed, in an exemplary aspect of the present disclosure, the PHA preferably comprises one or more PHAs selected from the group consisting of poly(3-hydroxybutyrate), poly(3-hydroxybutyrate-co-3-hydroxyvalerate), and poly(3-hydroxybutyrate-co-3-hydroxyhexanoate). Advantageously, these polymers have a molecular weight of from 100,000 g/mol to 1,000,000 g/mol and/or a melting point of from 100° C. to 200° C. Mixtures of one or more PHAs with poly(lactic acid) are also particularly useful. If a polyester is employed, in an exemplary aspect of the present disclosure, the polyester preferably comprises one or more polyesters selected from the group consisting of polycaprolactone, polyglycolide, poly(butylensuccinate), poly(lactic acid), polybutylenesuccinateadipate, polytrimethyleneterephthalate, polybutylenadipateterephthalate, polybutylensuccinateterephthalate, polybutylensebacateterephthalate. If a block copolymer of lactic acid is employed, in an exemplary aspect of the present disclosure, the block copolymer of lactic acid comprises lactic acid-caprolactone-lactic acid copolymers, lactic acid-ethylene oxide-lactic acid copolymers.

If expandable microspheres are used as foaming agent, the plastic material may further comprise one or more thermoplastic polymers selected from the group consisting of polymers formed from monomer units selected from vinylidene chloride, acrylonitrile and methyl methacrylate; copolymers formed from two or more monomer units selected from vinylidene chloride, acrylonitrile and methyl methacrylate; and combinations of any two or more thereof.

A particularly preferred biodegradable thermoplastic polymer is one or more aliphatic-aromatic copolyesters. According to a preferred aspect of the closure precursor, the closure precursor comprises an aliphatic-aromatic copolyester. The aliphatic-aromatic copolyester is preferably selected from aliphatic-aromatic copolyesters having a glass transition temperature measured by Differential Scanning calorimetry (DSC) according to ASTM D3418-15 of less than 0° C., preferably less than −4° C., more preferably less than −10° C., more preferably less than −20° C., more preferably less than −30° C. The aliphatic-aromatic copolyester is preferably a statistical copolyester on the basis of at least adipic acid and/or sebacic acid. In a statistical copolyester, the constituting monomer units are irregularly distributed along the polymer chain. Statistical copolyesters are sometimes also referred to as random copolyesters. In general, aliphatic-aromatic copolyesters comprising terephthalate units derived from terephthalic acid or a substituted terephthalic acid as aromatic unit are preferred. Aliphatic-aromatic copolyesters comprising terephthalate units derived from terephthalic acid or a substituted terephthalic acid as aromatic unit and aliphatic units derived from difunctional aliphatic organic acids and/or difunctional aliphatic alcohols, such as aliphatic diacids, aliphatic diols, or aliphatic units comprising at least one alcohol functionality and at least one acid functionality, have been found capable of fulfilling the requirements imposed upon plastic materials for closures as described herein, in particular closures for wine bottles. Preferably, the aliphatic-aromatic copolyester according to the disclosure is a copolyester or a statistical copolyester on the basis of 1,4-butanediol, adipic acid or sebacic acid, and terephthalic acid or an ester-forming derivative of terephthalic acid. Preferably, the aliphatic-aromatic copolyester according to the disclosure exhibits a glass transition temperature measured according to ASTM D 3418-15 of from −25° C. to −40° C., more preferably from −30° C. to −35° C., and/or an area of melting temperatures of from 100° C. to 120° C., more preferably from 105° C. to 115° C. This ensures suitable handling and use properties in a typical temperature range.

Particularly preferred biodegradable thermoplastic polymers are one or more selected from the group consisting of polybutyleneadipateterephthalates; polybutylenesuccinateterephthalates; polybutylenesebacateterephthalates; and combinations of two or more thereof. A suitable commercially available biodegradable thermoplastic aliphatic-aromatic copolyester is Ecoflex® C1200 from BASF SE, Ludwigshafen, Germany or from BASF Corporation of Wyandotte, Mich. (US). Ecoflex® C1200 is a polybutylene adipate terephthalate (PBAT) copolymer that is a statistical, aliphatic-aromatic copolyester based on the monomers 1,4-butanediol, adipic acid and terephthalic acid in the polymer chain.

If the closure precursor comprises one or more peripheral layers, the peripheral layer or layers can comprise a thermoplastic polymer identical or similar to the thermoplastic polymer comprised in the core member. A peripheral layer can, on the other hand, comprise a thermoplastic polymer which is different from the thermoplastic polymer or thermoplastic polymers comprised in the core member.

According to an exemplary aspect, the closure precursor used in the present disclosure comprises a core member and at least one peripheral layer, wherein the peripheral layer comprises at least one thermoplastic polymer selected from the group consisting of polyethylenes, metallocene catalyst polyethylenes, polypropylenes, metallocene catalyst polypropylenes, polybutenes, polybutylenes, other polyolefins, fluorinated polyolefins, particularly partially fluorinated or perfluorinated polyethylenes, polyurethanes, EPDM rubber, silicones, vinyl-based resins, thermoplastic elastomers, polyesters, ethylenic acrylic copolymers, ethylene-vinyl-acetate copolymers, ethylene-methyl-acrylate copolymers, thermoplastic polyurethanes, polyether-type polyurethanes, thermoplastic olefins, thermoplastic vulcanizates, flexible polyolefins, fluorelastomers, fluoropolymers, polyethylenes, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene and copolymerizable ethylenically unsaturated comonomers, olefin copolymers, olefin block copolymers, cyclic olefin copolymers, styrene ethylene butadiene styrene block copolymers, styrene ethylene butylene styrene block copolymers, styrene ethylene butylene block copolymers, styrene butadiene styrene block copolymers, styrene butadiene block copolymers, styrene isoprene styrene block copolymers, styrene isobutylene block copolymers, styrene isoprene block copolymers, styrene ethylene propylene styrene block copolymers, styrene ethylene propylene block copolymers, polyvinylalcohol, polyvinylbutyral, polyhydroxyalkanoates, copolymers of hydroxyalkanoates and monomers of biodegradable polymers, aliphatic copolyesters, aromatic-aliphatic copolyesters, poly(lactic acid), copolymers of lactic acid and monomers of biodegradable polymers, polycaprolactone, polyglycolide, poly(3-hydroxybutyrate), poly(3-hydroxybutyrate-co-3-hydroxyvalerate), poly(3-hydroxybutyrate-co hydroxyhexanoate), poly(butylensuccinate), poly(butylensuccinate-co-adipate), poly(trimethyleneterephthalate), poly (butylenadipate-co-terephthalate), poly(butylensuccinate-co-terephthalate), poly(butylensebacate-co-terephthalate), lactic acid caprolactone lactic acid copolymers, lactic acid ethylene oxide lactic acid copolymers, and combinations of two or more thereof. According to an exemplary aspect of the present disclosure said at least one peripheral layer is further defined as comprising one selected from the group consisting of foamed plastics and non-foamed plastics, advantageously having a substantially greater density than the core member, in order to impart desired physical characteristics to the bottle closure of the present disclosure. In particular, the composition employed for the at least one peripheral layer is particularly selected to withstand the compression forces imposed thereon by the jaws of the corking machine. However, many different polymers, as detailed herein, are able to withstand these forces and, as a result, can be employed for the at least one peripheral layer.

Particular examples of the plastic material for the at least one peripheral layer are polyethylene, a thermoplastic vulcanizate, styrene ethylene butylene styrene block copolymers, poly(butyleneadipateterephthalate) (PBAT), lactic acid-caprolactone-lactic acid copolymers, and combinations thereof. If desired, said at least one peripheral layer can be formed from a transparent material. Furthermore, the material selected for said at least one peripheral layer may be different from that of the core member.

In order to form bottle closures comprising a core member and at least one peripheral layer with some or all of the desirable inherent physical and chemical properties detailed above, it can be advantageous to comprise metallocene catalyst polyethylene in at least one peripheral layer. As detailed herein, at least one peripheral layer may comprise, for example, substantially metallocene catalyst polyethylene as single component, or the metallocene catalyst polyethylene may be combined with one or more thermoplastic elastomers, for example with one or more thermoplastic elastomers as detailed above. If the closure precursor comprises a peripheral layer, at least one peripheral layer may comprise, for example, one or more polyethylenes selected from the group consisting of medium density polyethylenes, medium low density polyethylenes, and low density polyethylenes in an amount in the range of from about 5% to about 100% by weight, particularly in the range of from about 5% to about 80% by weight, particularly in the range of from about 10% to about 60% by weight, particularly in the range of from about 15% to about 40% by weight, based upon the weight of the entire composition.

While peripheral layers comprising polyethylenes provide preferred closure performance properties, in order to form bottle closures comprising a core member and at least one peripheral layer with some or all of the desirable inherent physical and chemical properties according to the present invention, in particular increased environmental friendliness, in particular increased closure biodegradability, it is preferred that at least one peripheral layer, if one or more peripheral layers are present, comprises poly(butyleneadipateterephthalate) (PBAT). As detailed herein, at least one peripheral layer, if present, may comprise PBAT as substantially the sole polymer component or, if desired, PBAT may be combined with one or more thermoplastic elastomers, particularly with one or more thermoplastic elastomers as detailed above, particularly with one or more biodegradable thermoplastic elastomers as detailed above. In this regard, it has been found advantageous that at least one peripheral layer particularly comprises one or more polyesters selected from the group of biodegradable polyesters in an amount in the range of from about 5% to about 100% by weight, particularly in the range of from about 15% to about 95% by weight, particularly in the range of from about 25% to about 90% by weight, based upon the weight of the entire composition.

In an exemplary construction of this embodiment, the preferred PBAT employed for forming the at least one peripheral layer is or comprises Ecoflex®, which is sold by BASF Corporation of Wyandotte, Mich. (US). This compound has been found to produce an outer layer in combination with the core member which achieves at least one, particularly more than one, particularly almost all or even all of the physical and chemical characteristics suitable for attaining a highly effective closure for the wine industry.

A formulation which has been found to be highly effective in providing a peripheral layer comprises at least one lactic acid and/or at least one styrene block copolymer. Suitable styrene block copolymers which come into consideration can be selected from the group consisting of styrene ethylene butadiene styrene block copolymers, styrene ethylene butylene styrene block copolymers, styrene ethylene butylene block copolymers, styrene butadiene styrene block copolymers, styrene butadiene block copolymers, styrene isobutylene block copolymers, styrene isoprene styrene block copolymers, styrene isoprene block copolymers, styrene ethylene propylene styrene block copolymers, styrene ethylene propylene block copolymers and combinations of two or more thereof. In particular aspects of the present disclosure, the at least one styrene block copolymer is selected from the group consisting of styrene ethylene butadiene styrene block copolymers, styrene ethylene butylene styrene block copolymers, styrene ethylene propylene styrene block copolymers, styrene ethylene propylene block copolymers and combinations of two or more thereof. Examples of commercially available styrene block copolymers according to the present disclosure are SBS, SIS, SEBS, SIBS, SEPS, SEEPS, MBS, which are available, for example under the trade names Styroflex® and Styrolux® (BASF Corporation of Wyandotte, Mich., USA), Septon® Q, Septon® V, and Hybar (Kuraray America, Inc., Houston, Tex., USA), Maxelast® TPE (Nantong Polymax Elastomer Technology Co., Ltd), GLOBALPRENE® Polymers (LCY Chemical Corporation), Elexar® and Monprene® (Teknor Apex Company), Elastocon® series (Elastocon TPE Technologies, Inc.), TPR (Washington Penn), Evoprene™ (Alpha Gary), Versaflex®, OnFlex®, Versalloy®, Versollan®, Dynaflex® (GLS Thermoplastic Elastomers), Sevrene™ (Vichem Corporation), Vector' (Dexco Polymers LP), Calprene® and Solprene® (Dynasol), Multiflex® TEA and Multiflex® TPE (Multibase, Inc.), Europrene® Sol T (Polimeri Europe), Sunprene™ (PolyOne), Leostomer® (Riken Technos Corporation), RTP 2700 and 6000 series (RTP), Invision® (A. Schulman), Dryflex® (VTC Elastotechnik), Quintac® (Zeon), Megol® and Raplan® (API spa), Asaprene™ and Tufprene™ (Asahi Kasei), Lifoflex Kunststoffe, Germany), Thermolast® (Kraiburg TPE GmbH & Co. KG, Waldkraiberg, Germany) or Kraton®, for example Kraton® D, Kraton® G or Kraton® FG (Kraton Polymers, Houston, Tex., USA). Suitable lactic acid copolymers which come into consideration can be selected from the group consisting of lactic acid caprolactone lactic acid block copolymers, lactic acid ethylene oxide lactic acid block copolymers, and mixtures thereof. Further sources for biodegradable polymers can be found in "Bio-Based Plastics: Materials and Applications", Stephan Kabasci, editor, John Wiley & Sons, 2014, ISBN 978-1119994008.

Another formulation which has been found to be highly effective in providing a peripheral layer comprises at least one thermoplastic vulcanizate.

Another formulation which has been found to be highly effective in providing a peripheral layer which provides at least one, particularly more than one, particularly almost all or even all physical and chemical attributes to attain a commercially viable closure comprises at least one of at least one polyether-type thermoplastic polyurethane and at least one olefin block copolymer or a blend of at least two thereof.

Each of the materials disclosed as suitable for a peripheral layer can be used alone or in combination with one or more of these materials. By employing this material or these materials and forming the material or the materials in peripheral, surrounding, bonded engagement with any desired foamed core member, a highly effective, multi-layer closure precursor can be attained which can be used to provide at least one, particularly more than one, particularly almost all or even all properties suitable for a wine bottle closure.

In an exemplary construction of this embodiment, the particular polyether-type thermoplastic polyurethane employed for forming the at least one peripheral layer comprises Elastollan® LP9162, manufactured by BASF Corporation of Wyandotte, Mich. (US). This compound has been found to produce an outer layer in combination with the core member which provides at least one, particularly more than one, particularly almost all or even all of the physical and chemical characteristics suitable for attaining a highly effective closure for the wine industry.

In another exemplary aspect of the closure precursor comprising a core member and at least one peripheral layer, the peripheral layer comprises thermoplastic vulcanizates (TPV). Such thermoplastic vulcanizates are well known in the art and are commercially available, for example, under the trade name Santoprene® from ExxonMobil Chemical Company of Houston, Tex. (US), Sarlink® from Teknor Apex B.V., Geleen (NL) or OnFlex® from PolyOne Inc. of Avon Lake, Ohio (US).

In addition to employing the polyether-type thermoplastic polyurethane detailed above, another composition that has been found to be highly effective in providing at least one, particularly more than one, particularly almost all or even all of the desirable attributes for at least one peripheral layer is a blend of at least one polyolefin, particularly at least one thermoplastic polyolefin and at least one thermoplastic vulcanizate. The construction of a closure precursor using a peripheral layer formed from this blend provides a closure precursor which is highly suitable for use as a wine bottle closure.

A further composition that can provide at least one, particularly more than one, particularly almost all or even all of the desirable attributes for at least one peripheral layer is a blend of at least one polyolefin, particularly at least one thermoplastic polyolefin, and at least one styrene block copolymer, or a blend of at least one thermoplastic vulcanizate and at least one styrene block copolymer. The construction of a closure precursor using a peripheral layer formed from this blend provides a closure which is highly suitable for use as a wine bottle closure.

In a further alternate embodiment, a closure precursor can be attained by employing at least one of at least one metallocene catalyst polyethylene and at least one olefin block copolymer, either independently or in combination with at least one selected from the group consisting of low density polyethylenes, medium density polyethylenes, and medium low density polyethylenes.

A further composition that has been found to be highly effective in providing at least one, particularly more than one, particularly almost all or even all of the desirable attributes for at least one peripheral layer, and is preferred according to the present invention, is a blend of at least one polyester, particularly at least one statistical aromatic-aliphatic copolyester, and at least one lactic acid block copolymer. A suitable blend of at least one polyester, preferably at least one statistical aromatic-aliphatic copolyester, preferably PBAT, and at least one lactic acid polymer or lactic acid derivative, in particular at least one lactic acid block copolymer, comprises the polyester, preferably the statistical aromatic-aliphatic copolyester in an amount in the range of from about 5% to about 95% by weight, or in an amount in the range of from about 20% to about 80% by weight, or in an amount in the range of from about 30% to about 70% by weight, or in an amount in the range of from about 40% to about 60% by weight, based upon the weight of the entire composition of and the lactic acid polymer or lactic acid derivative, preferably the lactic acid block copolymer, in an amount in the range of from about 95% to about 5% by weight, particularly in an amount in the range of from about 80% to about 20% by weight, particularly in an amount in the range of from about 70% to about 30% by weight, particularly in an amount in the range of from about 60% to about 40% by weight, based upon the weight of the entire composition. Exemplary weight ratios of lactic acid block copolymer to statistical aliphatic-aromatic copolyester are about 95:5, about 90:10, about 85:15, about 80:20, about 75:25, about 70:30, about 65:35, about 60:40, about 55:45, about 50:50, based on the total weight of lactic acid block copolymer and statistical aliphatic-aromatic copolyester. The construction of a closure precursor using a peripheral layer formed from this blend provides a closure precursor which is highly suitable for providing a wine bottle closure, particularly a biodegradable wine bottle closure.

Still further additional compounds which have been found to provide highly effective peripheral layers for forming closures, in accordance with the present disclosure, comprise Teflon®, fluoroelastomeric compounds and fluoropolymers. These compounds, whether employed individually or in combination with each other or with the other compounds detailed above have been found to be highly effective in producing a peripheral layer which is capable of providing at least one, particularly more than one, particularly almost all or even all of the properties making it suitable for bottle closures.

Any of the compounds detailed herein for providing the at least one peripheral layer can be employed alone or in combination with each other, using suitable preparation methods detailed herein to produce a peripheral layer which is securely and integrally bonded to the core member and/or to a different peripheral layer, as a foamed outer layer or a non-foamed outer layer, or as an intermediate layer.

According to a particular aspect of the present disclosure, at least one, preferably each, thermoplastic polymer comprised in the peripheral layer is biodegradable according to ASTM D6400.

The at least one peripheral layer, if present, particularly the outer peripheral layer is particularly formed with a thickness and/or a density which are capable of imparting desired physical characteristics, such as resistance to bottling conditions, to the closure precursor and/or closure of the present disclosure. The at least one peripheral layer, particularly the outer peripheral layer is, in particular, formed with a substantially greater density than the inner core and/or with a selected thickness.

Accordingly, said at least one peripheral layer, if present, is particularly further defined as comprising a thickness ranging from about 0.05 mm to about 5 mm. Although this range has been found to be efficacious for producing a closure precursor which is completely functional and achieves most or all of the desired goals, the exemplary aspect for wine bottles particularly comprises a thickness ranging from about 0.05 mm to about 2 mm, whereby exemplary lower limits for the thickness are about 0.05 mm, about 0.06 mm, about 0.07 mm, about 0.08 mm, about 0.09 mm, about 0.1 mm, about 0.2 mm, about 0.3 mm, about 0.4 mm or about 0.5 mm and exemplary upper limits for the thickness are about 1 mm, about 2 mm, about 3 mm, about 4 mm, or about 5 mm. The exemplary thickness of the at least one peripheral layer, if present, can be selected according to criteria such as, for example, the composition, physical properties and/or density of the material of the at least one peripheral layer, and the desired properties of the at least one peripheral layer.

As discussed herein, intimate bonded interengagement of the at least one peripheral layer, if present, to the core member is advantageous for providing a closure precursor for a bottle closure capable of being used in the wine industry. In this regard, although it has been found that the methods detailed herein provide secure intimate bonded interengagement of the at least one peripheral layer to the core member, alternative layers or bonding chemicals can be employed, depending upon the particular materials used for forming the core member and the at least one peripheral layer.

If desired, for a closure precursor comprising a core member and at least one peripheral layer, bonding agents or tie layers known to the skilled person can be employed on the outer surface of the core member in order to provide secure intimate bonded interengagement of the at least one peripheral layer therewith. If a tie layer is employed, the tie layer would effectively be interposed between the core member and the at least one peripheral layer to provide intimate bonded interengagement by effectively bonding the peripheral layer and the core member to the intermediately positioned tie layer. However, regardless of which process or bonding procedure is employed, all of these alternate embodiments are within the scope of the present disclosure. If more than one peripheral layer is present, such bonding agents or tie layers can similarly be employed between respective peripheral layers.

The closure precursor may comprise cork. The cork may in particular be in the form of cork particles. The cork particles (or coated cork particles as defined herein) may have a particle size distribution measured by means of mechanical sieving, according to the ISO standard test method ICS 19.120, such that the D50 value is in the range of from 0.25 millimetres to 5 millimetres. The plurality of particles preferably has a D50 determined according to test method ICS 19.120, in the range of from 0.3 mm to 3 mm, or in the range of from 0.5 mm to 2.0 mm, particularly in the range of from greater than 1.0 mm to 2.0 mm.

Alternatively or additionally, the cork particles (or the coated particles as defined herein) may be defined by their average or mean particle size measured by means of mechanical sieving, according to the ISO standard test method ICS 19.120. Preferably, the average or mean particle size of the particles is in the range of from 0.25 mm to 5 mm, preferably in the range of from 0.5 mm to 4 mm, preferably in the range of from 0.5 mm to 6 mm, preferably in the range of from 0.5 mm to 5.0 mm, preferably in the range of from 0.5 mm to 4.0 mm, preferably in the range of from 0.8 mm to 4.0 mm, preferably in the range of from 0.8 mm to 3.8 mm, preferably in the range of from 0.8 mm to 3.5 mm, preferably in the range of from 1.0 mm to 3.5 mm, preferably in the range of from 1.0 mm to 3.3 mm, most preferably in the range of from 1.0 mm to 3.0 mm. The plurality of particles can alternatively or additionally have an average or mean particle size or a $D_{50}$ value in the range of from greater than 2.0 mm to 10.0 mm, particularly in the range of from greater than 2.0 mm to 8.0 mm, preferably in the range of from greater than 2.0 mm to 5.0 mm, or in the range of from greater than 2.0 mm to 4.0 mm, preferably in the range of from greater than 2.0 mm to 3.5 mm, particularly in the range of from greater than 2.0 mm to 3.0 mm. Preferred ranges for the average or mean particle size or $D_{50}$ are selected from the ranges of from 0.9 mm to 1.0 mm, from 1.0 mm to 2.0 mm, from 1.5 mm to 2.5 mm, from 2.0 mm to 3.0 mm, from 2.5 mm to 3.5 mm, and from 3.0 mm to 4.0 mm. Particularly preferred ranges for the average particle size or D50 are selected from the ranges of from 1.0 mm to 2.0 mm, and from 2.0 mm to 3.0 mm, or from greater than 1.0 mm to less than 2.0 mm, or from greater than 2.0 mm to 3.0 mm.

As used herein, the term "particle" may refer to the core comprising cork material (e.g. a cork particle forming the core of a coated particle as defined herein) or to the coated particle as defined herein or to both. The same applies to the term "plurality of particles".

The cork particles may have a substantially isotropic shape, in particular a substantially spherical shape.

The cork material is preferably suitable for food contact. The cork material is preferably a plurality of "clean" cork particles. This means that the particles are cleaned or washed using an appropriate cleaning or washing method, before being incorporated into or used in the inventive closures. The plurality of clean particles is preferably free or substantially free from any contaminants, for example contaminants that might be present from previous uses or processing steps, as well as agents that can affect the taste, smell, and/or other properties of the product to be retained in the container. The plurality of clean particles is particularly preferably free or substantially free from organoleptic agents, in particular free from all or substantially all haloanisoles, in particular TCA, but also optionally TBA, TeCA and/or PCA. If the plurality of particles is a plurality of cork particles, the particles have preferably been washed in order to remove all or substantially all organoleptic agents, in particular all or substantially all haloanisoles, in particular TCA, but also optionally TBA, TeCA and/or PCA which may be present in cork. Such a washing step can be effected, for example, by means of any suitable solvent, including, but not limited to, organic solvents such as hydrocarbons, aqueous fluids such as washing solutions or dispersions which are capable of removing TCA from cork, or supercritical fluids such as supercritical carbon dioxide. Environmentally friendly solvents which are also food-safe are preferred, such as aqueous fluids or supercritical fluids. During a washing step the cork particles can be suspended in the solvent, optionally agitated, and then the solvent removed by filtration or the like. A washing step can be repeated as many times as necessary to achieve an acceptable level of haloanisoles, particularly of chloroanisoles, particularly of TCA, but also optionally TBA, TeCA and/or PCA, in the particles, in particular in the cork particles. The amount of haloanisole released from a cork into wine can be measured as so-called "releasable haloanisole" by soaking a cork or a sample of corks in a wine for 24 hours for an untreated cork or 48 hours for a treated cork, and measuring the amount of each haloanisole compound in the wine, for example by means of chromatographic or spectroscopic methods such as gas chromatography or nuclear magnetic resonance spectroscopy. An acceptable level is generally considered to be one which results in an amount of the respective chloroanisole or chloroanisoles in the wine which is below the average sensory threshold of about 6 ng/L for TCA or TBA, whereby TeCA and PCA have been reported to be respectively about three times and one thousand times less potent in their sensory thresholds. The cork particles preferably have a content of releasable trichloroanisole measured according to the test method described above of less than 6 ng/L, preferably less than 5 ng/L, more preferably less than 4 ng/L, more preferably less than 3 ng/L, even more preferably less than 2 ng/L, most preferably less than 1 ng/L. A closure and/or a closure precursor disclosed herein preferably has a content of releasable trichloroanisole of less than 2 ng/L, preferably less than 1 ng/L, preferably less than 0.5 ng/L, preferably less than 0.3 ng/L.

The cork material preferably has a humidity in the range of from about 0% to about 10%, particularly in the range of from about 0% to about 8%, particularly in the range of from about 0% to about 8%, particularly in the range of from about 0% to about 7%, particularly in the range of from about 0% to about 6%, more particularly in the range of from about 0% to about 5%, more particularly in the range of from about 0% to about 5%, more particularly in the range of from about 0% to about 4%, more particularly in the range of from about 0% to about 3%, more particularly in the range of from about 0% to about 2%, more particularly in the range of from about 0% to about 1%. Preferably, the cork particles have a water content of less than 8 wt. %, in particular less than 7 wt. %, less than 6 wt. %, less than 5 wt. %, less than 4 wt. %, less than 3 wt. %, in particular less than 2 wt. %, less than 1.5 wt. % or less than 1 wt. %, in each case based on the total weight of the cork particles.

Advantageously, the cork particles have a density in the range of 50 to 200 g/L.

According to an embodiment, the cork, in particular the cork particles, is/are bleached. A closure precursor comprising bleached cork or bleached cork particles can provide a surface with a uniform and light color on which the decorative layer can be applied with large flexibility.

In particular, if the closure precursor contains cork particles, the cork particles (or the coated particles as defined herein) are preferably homogeneously distributed within the polymer matrix, preferably substantially each individual particle is surrounded by and embedded within the polymer matrix. Accordingly, in an embodiment, the cork particles are preferably distributed homogeneously throughout the closure precursor. This is possible because the formulation enables a processability that allows the formation of a polymer matrix by means of extrusion, the polymer matrix having physical properties, such as cellular structure and cell density, that support a homogeneous distribution of cork particles (or the coated particles as defined herein) throughout the polymer matrix. The homogeneous distribution of cork particles (or the coated particles as defined herein) is advantageous because it allows individual particles to be coated by and/or embedded within the polymer matrix, which avoids the formation of localized clusters of particles without sufficient polymer, which in turn can cause weak spots and crumbling of a closure and/or closure precursor.

According to one aspect of the closure precursor used in the present disclosure, the closure comprises a core member and does not comprise a peripheral layer. In this aspect, the core member forms the entire closure precursor, and a plurality of particles is comprised in the core member. This aspect can be advantageous particularly in reducing cost per closure, and simplifying the production.

If a peripheral layer is comprised and if the closure precursor comprises cork particles, the cork particles (or the coated particles as defined herein) are comprised in at least one of the core member and the peripheral layer, preferably in either the core member or the peripheral layer, or in the core member and the peripheral layer.

In a particular aspect of the present disclosure the cork particles (or the coated particles as defined herein) are comprised in the core member and in the peripheral layer, if a peripheral layer is present.

In a further aspect of the present disclosure the plurality of particles is comprised in the core member, and is substantially absent from the peripheral layer, if a peripheral layer is present.

In a particular aspect of the present disclosure the closure precursor comprises a peripheral layer and cork particles (or the coated particles as defined herein) that are comprised in the peripheral layer. According to this aspect the cork particles (or the coated particles as defined herein) can be substantially absent from the core member.

In another embodiment, the closure precursor does not comprise a peripheral layer, or does not comprise a separately extruded peripheral layer.

The plurality of coated particles can be comprised in an amount in the range of from 51 wt. % to 80 wt. %, more particularly in an amount in the range of from 52 wt. % to 75 wt. %, more particularly in an amount in the range of from 53 wt. % to 70 wt. %, more particularly in an amount in the range of from greater than 55 wt. % to 65 wt. %, or in an amount in the range of from 51 wt. % to 60 wt. %, more particularly in an amount in the range of from 51 wt. % to 55 wt. %, in each case based on the total weight of the closure precursor.

According to an aspect of the invention, a closure precursor comprising a peripheral layer may comprise a plurality of coated particles in the peripheral layer. However, the plurality of coated particles is preferably comprised in the core member, or in both the core member and the peripheral layer.

The inclusion of the plurality of coated particles can detrimentally affect the processability of the composition used for preparing a closure precursor used in the present invention, as well as potentially negatively affecting closure performance and properties. In order to reduce or eliminate any reduction in processability or performance, particularly due to the plurality of coated particles, the closure precursor used in the present invention may optionally comprise one or more processing aids.

The one or more processing aids can be comprised in at least the component of the closure precursor that comprises the plurality of coated particles. The preferred processing aid or processing aids are preferably selected from processing aids that are capable of modifying the processability of the formulation during formation of the closure precursor, such as the melt processability of the formulation during formation of the closure precursor by means of extrusion or moulding, particularly by means of extrusion. Process and processability modifications can be, for example, reduction in operating pressure and/or temperature, reduced friction between the composition and the forming equipment, improved cork dispersibility in the polymer matrix, improved cork wettability in the polymer matrix, improved torque release for flow improvement during extrusion, reduction or elimination of melt fracture during extrusion, reduced die build-up, improved speed and increased output, melt viscosity, melt flow rate, melt index, thermal stability, and/or surface properties. The processing aid or processing aids preferably assist in improving mechanical and performance properties of the closure precursor and/or closure, such as cell size and/or cell density of the plastic material, cell stability, homogeneous distribution of the plurality of particles throughout the polymer matrix, viscosity under conditions of varying shear and/or temperature, in particular increased shear and/or temperature, and the like. One particular advantage that has been observed with the processing aid or processing aids is that the density of the plastic material in the closure and/or closure precursor can be reduced compared to the density of plastic material in closures not comprising one or more processing aids according to the invention. The lower density of the plastic material contributes to achieving the objects of the invention, such as, for example, reduced plastic material content of the closure and/or closure precursor, elasticity, compressibility, and uniform distribution of the plurality of particles throughout the plastic material. As the processing aid or processing aids remain in the closure precursor after its production, they are preferably suitable for use in food applications. It is preferred that one or more of the processing aid or processing aids is or are one or more of biodegradable, compostable, and thermoplastically processable. While it is possible that a single processing aid achieves all or most of the desired advantages, it is also possible that the processing aid comprises two or more processing aids. A suitable processing aid that can be used alone or in combination with one or more other processing aids can be, for example, a lubricant, a slip agent, a release agent, an antiblocking agent, or any agent or combination of agents that achieves one or more of the desired advantages. The closure precursor may comprise 0 to 15 wt. % of one or more lubricants, based on the total weight of the closure precursor. The closure precursor may comprise 0 to 10 wt. % of one or more additives and/or fillers, based on the total weight of the closure precursor.

Suitable optional processing aids that can be comprised in the closure precursor used in the invention are preferably selected from the group consisting of fatty acids; fatty acid esters; fatty acid amides; waxes; wax esters; ester waxes; plasticisers; alcohols; glycerol esters; polyol esters; polyol partial esters; polyglycol esters; fatty acid polyglycol esters; fatty acid polyglycol ethers; fatty alcohol polyglycol ethers; metallic soaps; fluoropolymers; polyols; silicones; glycerol monostearate; fatty acid esters of polyols; high molecular weight poly esters; and combinations of any two or more thereof. A suitable processing aid could also be a polymer blend resulting in a large molecular weight dispersity. For example, a processing aid might comprise a combination of higher molecular weight polymer with lower molecular weight polymer such that a broad molecular weight distribution is achieved which provides a lower melt viscosity. The polymer or polymers in such a polymer blend may be the same as one or more of the thermoplastic polymer or polymers comprised in the plastic material that forms the body of the closure precursor, in particular the core member of the closure precursor, or the entire closure precursor if no peripheral layer is comprised. In this case the amount of plastic material is increased by the amount of processing aid as disclosed herein. The polymer or polymers in such a polymer blend may also be different to at least one or more of the thermoplastic polymer or polymers comprised in the plastic material, such that the different polymer or polymer blend is comprised in the amount disclosed herein for the one or more processing aids. Such a polymer blend may be used as processing aid or processing aids, or may be used in combination with one or more of the other processing aids disclosed herein.

If two or more processing aids are employed, these preferably complement or supplement each other in terms of achieving the properties and advantages mentioned herein. For example, the processing aid can comprise at least one processing aid that reduces the melt viscosity of the plastic material, and at least one processing aid that aids the release of the plastic material from forming equipment, such as at least one processing aid that reduces the friction of the plastic material relative to at least one extruder surface during extrusion, and/or at least one processing aid that aids the release of the plastic material from a mould. The processing aid that reduces the friction of the plastic material relative to at least one extruder surface during extrusion may be the same as the processing aid that aids the release of the plastic material from a mould, or these may be different processing aids.

The one or more optional processing aids may be selected from processing aids as described herein. Any processing aid may be combined with any other processing aid, in order to achieve the objectives and advantages of the present invention. According to a preferred aspect of the invention, at least one processing aid that reduces the melt viscosity of the plastic material is selected from the group consisting of fatty acids; fatty acid esters; fatty acid amides; waxes; wax esters; ester waxes; plasticisers; alcohols; glycerol esters; polyol esters; polyol partial esters; polyglycol esters; fatty acid polyglycol esters; fatty acid polyglycol ethers; fatty alcohol polyglycol ethers; glycerol monostearate; metallic soaps; and combinations of any two or more thereof; and at least one processing aid that reduces the friction of the plastic material relative to at least one extruder surface during extrusion is selected from the group consisting of fatty acids; fatty acid esters; fatty acid amides; fluoropolymers; polyols; silicones; glycerol esters; glycerol monostearate; polyol esters; polyol partial esters; polyglycol esters; fatty acid polyglycol esters; fatty acid polyglycol ethers; fatty alcohol polyglycol ethers; fatty acid esters of polyols; wax esters; ester waxes; metallic soaps; high molecular weight poly esters; and combinations of any two or more thereof.

It can be advantageous in the closure and/or the closure precursor according to the invention that, at atmospheric pressure, at least one processing aid is solid or at least partially solid at temperatures up to 160° C., or at temperatures up to 150° C., or at temperatures up to 140° C., or at temperatures up to 130° C., or at temperatures up to 120° C. Optionally at least one processing aid comprises one or more fatty acid derivatives that are solid or at least partially solid at temperatures up to 160° C., or at temperatures up to 150° C., or at temperatures up to 140° C., or at temperatures up to 130° C., or at temperatures up to 120° C., at atmospheric pressure. This can be advantageous in terms of transport and storage of a processing aid, as well as in combining a processing aid with the plastic material and the plurality of particles, which can occur in a dry blending step, to form a homogeneous combination of processing aid with plastic material and plurality of particles. It is also preferred that the processing aid, which at least substantially remains in the closure precursor after formation of the closure, can be solid at use temperatures of the closure, for example in order to avoid bleeding of the processing aid or oily feel of the closure. It can be advantageous for processing and/or combining if the processing aid is softened, melted, or partially melted at processing temperatures. Typical processing temperatures are indicated herein in connection with the method of forming a closure precursor.

It can be advantageous in the closure precursor used in the invention that, at atmospheric pressure, at least one processing aid is at least partially in liquid form, for example at least partially in the form of a melt, at temperatures above 50° C. Optionally at least one processing aid comprises one or more fatty acid derivatives that are at least partially in liquid form at temperatures above 50° C. at atmospheric pressure. This could allow lower processing temperatures, while substantially not leading to bleeding of the processing aid from a finished closure or oily feel of a closure.

A processing aid suitable for the closure precursor used in the invention, can, for example, comprise one or more processing aids selected from the group consisting of fatty acid derivatives derived from a saturated or unsaturated fatty acid having from 12 to 45 carbon atoms, preferably from 25 to 38 carbon atoms; modified fatty acid derivatives derived from a modified, saturated or unsaturated fatty acid having from 12 to 45 carbon atoms, preferably from 25 to 38 carbon atoms; natural waxes; synthetic waxes; plasticizers; and combinations of two or more thereof. By way of example, the processing aid can comprise one or more fatty acid derivatives and/or modified fatty acid derivatives derived from a fatty acid selected from the group consisting of lauric acid, palmitic acid, arachidic acid, behenic acid, stearic acid, 12-hydroxystearic acid, oleic acid, erucic acid, recinolic acid, adipic acid, sebacic acid, myristoleic acid, palmitoleic acid, sapienic acid, elaidic acid, vaccenic acid, linoleic acid, linoelaidic acid, alpha-linolenic acid, gamma-linolenic acid, dihomo-gamma-linolenic acid, arachidonic acid, eicosapentaenoic acid, docosahexaenoic acid, caprylic acid, capric acid, myristic acid, lignoceric acid, cerotic acid, tridecylic acid, pentadecylic acid, margaric acid, nonadecylic acid, heneicosylic acid, tricosylic acid, pentacosylic acid, heptacosylic acid, montanic acid, nonocosylic acid, melissic acid, henatriacontylic acid, lacceroic acid, psyllic acid, geddic acid, ceroplastic acid, hexatriacontylic acid, heptatriacontanoic acid, octatriacontanoic acid, stearidonic acid, docosatetraenoic acid, palmitoleic acid, vaccenic acid, paullinic acid, elaidic acid, gondoic acid, nervonic acid, mead acid, modified fatty acids derived from one or more of the fatty acids comprised in the group, and mixtures of any two or more of the fatty acids and modified fatty acids comprised in the group.

It can be advantageous for the closure precursor used in the invention if the processing aid comprises one or more processing aids selected from the group consisting of erucamides; fatty acids; waxes; stearamides; glycerol monostearate; high-mono glycerol monostearate; glycerol ester; ethylene-bis-stearamide; calcium stearate; erucic acid amide; oleic acid amide; stearic acid amide; trimellitate esters; adipate esters; sebacate esters; azelaic esters; diesters; polymer plasticizers; and any combination of two or more thereof.

The processing aid can, for example, have one or more of the following properties:

a dropping point measured according to ASTM D2265 in the range of from 50° C. to 160° C., or in the range of from 50° C. to 150° C., or in the range of from 50° C. to 140° C., or in the range of from 50° C. to 130° C., in the range of from 50° C. to 120° C.;

a specific gravity in the range of from 0.900 to 1.300, measured according to ASTM D1298-12b, relative to water at 4° C.

The closure precursor used in the invention preferably does not comprise a binder; and/or the closure preferably does not comprise a crosslinking agent; and/or the plastic material is preferably not crosslinked by means of a crosslinking agent. Preferably the closure does not comprise a binder and does not comprise a crosslinking agent. The known closures comprising larger quantities, for example greater than about 50 wt. % based on the total weight of the closure, of cork powder or cork particles are generally agglomerates, in which the binder is typically a polyurethane or polyacrylate glue formed by means of in situ reactive polymerization of corresponding monomers and/or prepolymers, such as oligomers. These binders or glues are not thermoplastically processable, nor are they thermoplastic polymers or plastic materials according to the definition of the present invention. Known closures often comprise one or more crosslinking agents, also referred to as crosslinkers, in order to improve certain properties. Not only binders, or their monomers, but also crosslinkers, can give rise to food safety concerns. In addition, typically neither binders nor crosslinked polymers are either biodegradable or thermoplastically processable. It is thus generally not possible to recycle, biodegrade or compost a closure comprising binders or crosslinkers or crosslinked polymers. However, while it is preferred that the closure precursor and/or the closure according to the invention does not comprise crosslinker, it is possible that the closure precursor and/or the closure according to the invention comprises a small amount of crosslinker, for example in an amount sufficient to modify in a desired way the rheology of the composition used to prepare the closure, in particular the rheology of the thermoplastic component thereof, and/or to modify one or more other properties of the closure precursor and/or of the composition used to prepare the closure precursor, in particular of the thermoplastic component thereof, such as viscosity, elasticity, and/or hardness. The amount of crosslinker, if present, should be small enough so that the thermoplastic processability of the closure precursor is not affected, or at least is substantially not affected, in particular the recyclability of the closure and/or closure precursor is not affected, or at least is substantially not affected.

In one embodiment of the present disclosure, the closure precursor is produced by a process comprising at least a process step of extrusion. For closure precursors comprising a core member and at least one peripheral layer, this allows to achieve integral bonded interconnection between the at least one peripheral layer and the core member, since the at least one peripheral layer is formed about the core member in a manner which assures intimate bonded engagement.

According to a particular aspect of the closure and/or closure precursor, composition and methods according to the present disclosure, the temperature of the composition, the closure precursor, and/or any method step, particularly during formation of a closure precursor or a composition, preferably does not exceed 200° C., preferably is maintained in the range of from about 120° C. to about 170° C., or in the range of from about 125° C. to about 170° C., or in the range of from about 130° C. to about 165° C., or in the range of from about 135° C. to about 165° C., or in the range of from about 140° C. to about 160° C. An extrusion temperature in the disclosed range is particularly maintained during extrusion of a material comprising cork particles. If the temperature exceeds this range there is a risk of degradation of the cork particles, as well as burnt aromas which could affect a food product coming into contact with the closure.

It has also been found that further additional additives may be incorporated into the closure and/or closure precursor of the present disclosure. For a closure precursor used in the disclosure comprising a core member and at least one peripheral layer, the additives may be incorporated into either the core member and/or the at least one peripheral layer of the closure precursor in order to provide further enhancements and desirable performance characteristics. These additional additives can include, for example, colouring agents, such as pigments, antimicrobial agents, antibacterial compounds, and/or oxygen scavenging materials. Suitable additives are known to the person skilled in the art. The antimicrobial and antibacterial additives can be incorporated into the closure to impart an additional degree of confidence that in the presence of a liquid the potential for microbial or bacterial growth is extremely remote. These additives preferably have a long-term time release ability and further increase the shelf life without further treatments by those involved with the bottling of wine. Furthermore, it is possible for the cells of the closure precursor and/or closure to be substantially filled with a non-oxidizing gas, in order to further reduce oxygen ingress into the container. Ways of achieving this are known in the prior art. It is possible for one or more fillers, preferably particulate fillers, preferably particulate fillers having a particle size less than 0.2 mm, to be incorporated into the closure precursor according to the invention, preferably by being incorporated into the composition for preparing the closure precursor used in the invention. Preferred fillers are inorganic fillers such as mineral fillers, which may be selected from talc, chalk, silica, mica, alumina, clay, calcium carbonate, magnesium carbonate, calcium aluminate, titanium dioxide, vermiculite, perlite, and combinations of one or more thereof. It can be advantageous to include one or more fillers, for example to modify the rheology or other properties of the closure precursor and/or of the composition, Depending upon the sealing process to be employed for inserting the closure of the present disclosure in a desired bottle, additives, such as slip additives, lubricating agents, and sealing compounds may be incorporated into a peripheral layer if the closure precursor used in the present disclosure comprises a core member and at least one peripheral layer, for example to provide lubrication of the closure during the insertion process. In addition, other additives typically employed in the bottling industry may be incorporated into the closure precursor used in the present disclosure for improving the sealing engagement of the closure with the bottle as well as reducing the extraction forces necessary to remove the closure from the bottle for opening the bottle.

Additionally, indicia comprising ink that is invisible under normal lighting and/or temperature conditions can be comprised in the closure. Normal lighting conditions in the context of this disclosure means light from a light source having a spectrum that substantially comprises the visible range of the spectrum. Normal temperature conditions in the context of this disclosure means a temperature from 10° C. to 35° C. These indicia can, for example, be useful as registration marks. These indica can for example be part of the ornamental layer described herein.

The closure according to the present disclosure can further comprise a lubricant layer on at least one of its surfaces, in particular on its peripheral surface. The lubricant layer can comprise, for example, one or more of a silicone, a wax, a paraffin, and a Teflon® layer, or any type of layer known for natural cork or synthetic closures. Such a layer can help for example with insertion of the closure into a container and be formed by any means known and appearing suitable. If a silicone, wax and/or paraffin layer is present, this can be formed, for example, by extrusion and/or by tumbling.

By employing the materials and methods disclosed herein, a highly effective, closure can be attained which is able to provide at least one, particularly more than one, particularly almost all or even all properties suitable for a wine bottle closure.

The closure precursor and/or closure according to the present disclosure has advantageous properties making it particularly suitable for packaging and in particular for use as a closure for wine bottles. If the product is packaged under inert conditions, the closure advantageously has an oxygen ingress rate measured according to ASTM F1307 of less than about 5 mg oxygen per container in the first 100 days after closing the container. The oxygen ingress rate is advantageously selected from the group consisting of less than about 3 mg oxygen, less than about 1 mg oxygen, less than about 0.5 mg oxygen, less than about 0.25 mg oxygen, less than about 0.2 mg oxygen and less than about 0.1 mg oxygen, per container in the first 100 days after closing the container. The closure precursor and/or closure according to the present disclosure or produced according to the methods of the present disclosure achieves at least a comparable performance to known closures from alternative materials such as polymers with respect to use as a closure for wine bottles, as measured by, for example, at least one of, particularly more than one of, particularly all of the properties of oxygen transfer rate, extraction force, and leakage. In addition, the closure precursor and/or the closure according to the present disclosure or produced according to the methods of the present disclosure has an appearance resembling that of natural cork and can in some aspects preferably be branded in the same way as a natural cork closure. Furthermore, the tactile properties of the closure according to the present disclosure are very similar to a closure from natural cork.

The closure according to the invention preferably has an oxygen transfer rate measured according to ASTM F1307 in 100% oxygen of less than 0.05 cc/day, preferably in the range of from 0.0001 cc/day to 0.05 cc/day, preferably in the range from 0.0002 cc/day to 0.02 cc/day, or from about 0.0001 cc/day/closure to about 0.1000 cc/day/closure, or from about 0.0005 cc/day/closure to about 0.050 cc/day/closure.

The details and properties of all components of the closure and/or closure precursor also apply to the compositions and methods according to the present disclosure as described hereinbelow.

Advantageously, the closure according to the present disclosure has an extraction force determined according to the herein described test method of not more than about 445 N (100 lb), particularly of not more than about 440 N, particularly of not more than about 430 N, particularly of not more than about 420 N, particularly of not more than about 410 N, preferably not more than about 400 N, particularly of not more than about 390 N, particularly of not more than about 380 N, particularly of not more than about 370 N, particularly of not more than about 360 N, particularly of not more than about 350 N, particularly of not more than about 340 N, particularly of not more than about 330 N, more particularly of not more than about 320 N, more particularly of not more than about 310 N, more particularly of not more than about 300 N, whereby extraction forces in the range of from about 200 N to about 400 N, particularly in the range of from about 210 N to about 380 N, particularly in the range of from about 220 N to about 350 N, particularly in the range of from about 230 N to about 300 N are advantageously achieved. The extraction force describes the force needed to remove a closure from a container, in particular from a bottle, under standardized conditions. A lower extraction force relates to a greater ease of extraction of the closure. An extraction force in the range of from about 150 N to about 445 N is generally considered acceptable for a wine bottle closure. The presently disclosed closures achieve extraction force within the range considered acceptable for wine bottle closures.

The plastic material, thermoplastic polymers, plurality of particles, processing aids, additives, and blowing agents, and all details relating thereto, including preferred embodiments and aspects, are as defined herein with respect to the closure and/or the closure precursor, the composition for forming a closure precursor, the method for forming a composition, and the method for forming a closure precursor.

A closure precursor comprising cork particles can be produced in an exemplary method described hereafter which is not intended to be limiting. According to an embodiment, the closure precursor may be produced by a method for manufacturing a closure precursor for closure for a product-retaining container constructed for being inserted and securely retained in a portal-forming neck of said container, said method comprising at least the following method steps:

i. intimately combining the following components, to form a composition:
   (a) 51 to 80 wt. % (dry weight) of a plurality of particles comprising cork and having a particle size distribution $D_{50}$ measured by means of mechanical sieving according to ISO ICS 19.120 in the range of from 0.25 millimetres to 5 millimetres;
   (b) 12 to 49 wt. % of a plastic material comprising one or more thermoplastic polymers;
   (c) optionally, 0 to 10 wt. % of one or more blowing agents;
   (d) optionally, 0 to 15 wt. % of one or more lubricants;
   (e) optionally, 0 to 2 wt. % of one or more pigments; and
   (f) optionally, 0 to 10 wt. % of one or more additives and/or fillers;
ii. heating the composition obtained in step i. to form a melt;
iii. forming, by means of extrusion or molding, a raw closure precursor from the melt obtained in step ii, wherein the plurality of particles containing cork in the closure precursor have a water content of less than 3 wt. %;
iv. optionally cutting and/or finishing the raw closure precursor to form the closure precursor.

All features that heretofore have been described with respect to the closure and/or closure precursor used in the present disclosure likewise optionally also apply to the method of its formation.

The plastic material, thermoplastic polymers, plurality of particles, processing aids, additives, and optional blowing agents, and all details relating thereto, including amounts, preferred embodiments and aspects, as well as details relating to method steps, are as defined herein with respect to the closure and/or closure precursor, the composition for forming a closure precursor, the method for forming a composition, and the method for forming a closure precursor. The closure and/or closure precursor may be a cylindrical closure, comprising a peripheral surface and two substantially flat terminating end surfaces, such as a closure for a still wine bottle. Alternatively, the closure and/or closure precursor may be in the form of a closure for a sparkling wine bottle.

The plurality of particles is preferably a plurality of clean particles, as defined herein. It is conceivable to carry out at least one step of washing the plurality of particles, in particular to remove all or substantially all haloanisoles, in particular TCA, but also optionally TBA, TeCA and/or PCA, as disclosed herein. A closure precursor produced by a method disclosed herein preferably has a content of releasable trichloroanisole of less than 2 ng/L, preferably less than 0.5 ng/L, preferably less than 0.3 ng/L.

The method can be continuous or discontinuous. In a continuous method, the combining in method step i. can take place by means of any one or more of blending, dry blending, mixing, melting, pultrusion, extrusion, compounding, or any other method known to the skilled person and appearing suitable. Preferably, method step i. of any method defined herein involves applying shear to the components, preferably applying shear while heating. The composition resulting from method step i., which can be, for example, in the form of a dry blend or a melt, is then fed continuously to a moulding device or an extrusion device. The heating in method step ii. can be carried out at a time selected from during method step i.; after method step i. and before method step iii.; during method step iii.; or any combination of two or more thereof. In a preferred aspect of method steps i. and ii., which may be combined with any other aspect of the method or any method step, method step i. is carried out at atmospheric pressure or at a pressure below atmospheric pressure, and method step ii. is carried out at a pressure above atmospheric pressure. Preferably heating is carried out at least during method step iii. In a discontinuous method, any or all method steps can be discontinuous, or one or more method steps can be continuous or discontinuous. For example, a masterbatch of the composition can be pre-prepared in method step i., or a masterbatch of the plastic material and the plurality of particles can be pre-prepared as defined herein with respect to the composition, and optionally stored before further method steps. If a masterbatch of the plastic material and the plurality of particles is pre-prepared, this is then combined with all other components in method step i. of any method as described herein. In a discontinuous method, if one or more blowing agents are combined in a discontinuous method step, care must be taken that the temperature to which the blowing agent or blowing agents are exposed is below the initiation temperature for the blowing agent or agents, unless it is intended that the blowing agent or agents are combined during the method step in which foaming takes place. The respective initiation temperature depends on the blowing agent and is known or available to the skilled person.

The heating in method step ii. preferably occurs to a temperature at which the composition provided in method step i. can be foamed to the desired density, and/or the composition can be extruded or moulded to form the closure precursor. If a blowing agent is used which requires heat to provide or initiate the blowing effect, the heating in method step ii. preferably occurs to a temperature at which this blowing effect can occur. The blowing agent is preferably selected from the group consisting of expandable microspheres, chemical blowing agents, physical blowing agents, and combinations of two or more thereof. If the blowing agent comprises or consists of expandable microspheres, a temperature is selected at which the expandable microspheres expand to form expanded microspheres. The expanded microspheres form the individual cells of the plurality of cells. A temperature is preferably selected at which the expanded microspheres have a desired cell size. Suitable temperatures depend principally on the thermoplastic polymer and blowing agent selected and can be easily determined by the skilled person based on the known properties of the thermoplastic polymer and blowing agent and/or based on simple trials. The heating temperature is preferably maintained in the range of from about 120° C. to about 170° C. This temperature range is preferred for all method steps that involve heating, in particular method steps that involve heating a composition comprising cork particles (or coated particles as defined herein), including mixing, combining, extruding and moulding. The maintaining of an extrusion or moulding temperature in this range is particularly envisaged during extrusion or moulding of any composition comprising cork powder. During the heating step ii. the plastic material is preferably foamed. Particularly preferably the plastic material is foamed to a foam density in the range of from about 25 kg/m$^3$ to 800 kg/m$^3$, preferably in the range of from about 50 kg/m$^3$ to 800 kg/m$^3$, preferably in the range of from about 75 kg/m$^3$ to 800 kg/m$^3$, preferably in the range of from about 100 kg/m$^3$ to 800 kg/m$^3$, preferably in the range of from about 150 kg/m$^3$ to 700 kg/m$^3$, preferably in the range of from about 150 kg/m$^3$ to 600 kg/m$^3$, preferably in the range of from about 150 kg/m$^3$ to 500 kg/m$^3$, preferably in the range of from about 180 kg/m$^3$ to 500 kg/m$^3$, or in the range of from about 200 kg/m$^3$ to 450 kg/m$^3$, preferably in the range of from about 200 kg/m$^3$ to 420 kg/m$^3$.

According to a preferred aspect of the exemplary method for forming a closure precursor described herein, the second plastic material as used in the method according to the invention has a an average particle size distribution D50 measured by means of mechanical sieving according to ISO ICS 19.120 of less than 1000 microns, in particular less than 800, 600, 500, 400, 300, 200 or 50 microns. It was found that by using such small particle sizes for the second plastic material, difficulties in processability arising from the inclusion of the plurality of coated particles, as well as potentially negative effects on closure performance and properties, can be eliminated or reduced. Particles of plastic material of such size can be obtained, for example, by suitable milling techniques, such as cryogenic milling.

Method step iii. can be carried out in any way known to the skilled person and appearing suitable, in particular using known extrusion equipment or known moulding equipment. The use of the composition according to the invention means it is not necessary to modify the extrusion equipment or the moulding equipment, or any surfaces thereof, nor to modify significantly process or equipment parameters, for example to provide additional heating, in order to prevent undesirable phenomena such as surface melt fracture or surface roughness. This is particularly advantageous in large scale production facilities, particularly in a continuous production process, where it could be impractical, time consuming and expensive to modify significantly equipment and/or process parameters upon switching production from one type of closure to a different type of closure. This applies to all method steps, but especially to heating step ii. as well as to forming step iii.

If a peripheral layer is formed in the manufacturing method of the closure precursor, the details regarding the peripheral layer composition are the same as the details regarding suitable materials, compounds and compositions described herein with respect to a peripheral layer of the closure precursor of the present disclosure. Any peripheral layer, if present, is preferably formed by means of co-extrusion as described herein and known to the skilled person, which is preferably carried out substantially simultaneously with method step iii. According to a further aspect of the method, a method step to form a peripheral layer can be repeated one or more times in order to obtain one or more further peripheral layers, whereby the one or more further peripheral layers are separately extruded in intimate bonded engagement with the cylindrical outer surface of the previous peripheral layer to form a multilayer elongated cylindrical structure.

After the extrusion in method step iii., optionally with co-extrusion of one or more peripheral layers, the raw closure precursor, which is in the form of a continuous elongated cylindrical length of plastic material or a multilayer elongated structure, can be cooled by methods known to the skilled person. These include, for example, passing through a cooling bath, spraying, blowing and the like.

If the raw closure precursor is formed in method step iii. by means of extrusion, it is cut in method step iv. into lengths suitable for closure precursors. If the raw closure precursor is formed in method step iii. by means of moulding, it is not necessary to carry out cutting in method step iv. The closure precursor is preferably rectified in method step iv. In particular, the peripheral surface and optionally also the end surfaces of the closure are smoothed, for example by means of sanding, grinding, or polishing, preferably polishing, as is known for natural cork closures. The optional finishing in method step iv., which can be applied to the cut lengths or to moulded raw closure precursors, can be, for example, coating, or post-treating, any or all or which can be carried out in any way known and appearing suitable to the skilled person. Post-treating can comprise, for example, surface treatments such as plasma treatment, corona treatment, or providing a lubricant to the surface of the closure. If the outermost peripheral surface comprises cork particles, it may be desirable and/or possible to use branding to impart an image or writing onto the peripheral surface or one or both terminating surfaces of the closure, for example using branding methods known for natural cork closures.

All details disclosed herein for the closures and/or closure precursors according to the present disclosure are also relevant for the method as described in the above clauses 1 to 42 and therefore also form part of the disclosure of the method disclosed herein.

In a preferred embodiment of the use said closure has an oxygen ingress rate measured according to ASTM F1307 of less than about 1 mg oxygen per container in the first 100 days after closing the container. In a further preferred embodiment of the use the oxygen ingress rate is selected from the group consisting of less than about 0.5 mg oxygen, less than about 0.25 mg oxygen, less than about 0.2 mg oxygen and less than about 0.1 mg oxygen, per container in the first 100 days after closing the container.

The present disclosure also relates to a closure system comprising a product-retaining container and a closure according to the present invention.

According to the present disclosure, a closure can be realized which is capable of providing at least one, particularly more than one, particularly almost all or even all of the needs imposed thereupon by the wine industry, as well as any other bottle closure/packaging industry. As a result, a bottle closure can be attained that can be employed for completely sealing and closing a desired bottle for securely and safely storing the product retained therein, wherein the closure has the outer appearance of a cork closure made from a single piece of cork. The disclosure herein concerning the closure precursors used in the present disclosure also applies to the closure precursors prepared by the presently disclosed manufacturing method. The disclosure herein concerning the closure precursors prepared by the presently disclosed methods also applies to the closure precursors of the present disclosure.

According to an embodiment, the closure precursor contains a pigment or a dye, in particular 0 to 2 wt. % of at least one pigment or dye. In this way, a closure precursor can be obtained that has a lateral surface and flat terminating surfaces with a substantially uniform color, in particular a light uniform color. The decorative layer can be applied on such a closure with great flexibility. Many different pigments can be used in this embodiment. Advantageously, the pigment has a light color, in particular white. Preferably, the pigment comprises at least one of antimony(III) oxide ($Sb_2O_3$), barium sulfate ($BaSO_4$), lithopone ($BaSO_4$*ZnS), calcium carbonate, titanium oxide ($TiO_2$), and zinc oxide ($Zn_0$).

According to another embodiment, the closure precursor comprises an undercoating layer comprising an undercoating layer surface, the undercoating layer surface forming the lateral surface and/or the substantially flat terminating surfaces of the closure precursor. The undercoating layer preferably has a uniform color. Advantageously, the undercoating layer comprises a pigment or dye. The pigment or dye is preferably added to the formulation of the undercoating layer. Preferably, the undercoating layer is opaque. The undercoating layer can be applied in different ways to achieve a closure precursor. Preferably, the undercoating layer is applied by moulding, extrusion, coating, wrapping, or printing. For example, the undercoating layer can be applied as a peripheral layer to a core member. Preferably, the undercoating layer is applied by printing. The undercoating layer can be comprised by different types of closure precursors, for example synthetic closures, composite closures, cork particle agglomerate closures, closure precursors comprising thermoset polymers including polyurethane and/or adhesives including reactive and non-reactive adhesives or closures made from a single piece of cork. An undercoating layer can be applied on a closure made from a single piece of cork for example in case this closure otherwise does not look aesthetically appealing.

The undercoating layer preferably is opaque and has a uniform color. The uniform color of the undercoating layer is preferably selected from the group consisting of white, yellow, orange, ocher, and mixtures thereof, in particular from the group consisting of RAL 9001, RAL 9010, RAL 1000, RAL 1001, RAL 1002, RAL 1014, RAL 1015, RAL 8001, and mixtures thereof. Advantageously, the undercoating layer is white, for example RAL 9001 or RAL 9010 or mixtures thereof. The undercoating layer preferably does not resemble natural cork. Instead, it is preferred that the undercoating layer serves as an empty canvas for the application of the decorative layer.

An undercoating layer is particularly advantageous because it provides flexibility with respect to the closure precursor. As described above, an undercoating layer can be comprised by various closure precursors. With the application of the undercoating layer, an empty canvas is provided for the application of the decorative layer.

The invention also provides a method for applying a decorative layer on a closure precursor to yield a closure for a product retaining container, the closure precursor being constructed for being inserted and securely retained in a portal-forming neck of the container and having a substantially cylindrical shape and a longitudinal axis, and comprising substantially flat terminating surfaces forming the opposed ends of the closure precursor and a lateral surface, wherein the method comprises the step of passing the closure precursor through a decorative layer application system for applying a decorative layer on at least the lateral surface of the closure precursor, wherein the decorative layer at least partially covers the lateral surface of the closure precursor, wherein the lateral surface and the substantially flat terminating surfaces of the closure precursor have a uniform color at least immediately before applying the decorative layer to the lateral surface and the substantially flat terminating surfaces of the closure precursor. Advantageously, the decorative layer is also applied onto the substantially flat terminating surfaces of the closure precursor. The decorative layer preferably covers the lateral surface entirely. The decorative layer preferably covers the substantially flat terminating surface of the closure precursor entirely. Most preferably, the decorative layer covers the lateral surface and the substantially flat terminating surfaces of the closure precursor entirely. In this way, a closure with an outer appearance of a closure made from a single piece of cork all around can be achieved.

The uniform color of the lateral surface and optionally the substantially flat terminating surfaces of the closure precursor is preferably a color on which print can be applied with large flexibility, in particular a light color. In this way, the closure precursor is a clear canvas on which a decorative layer can be applied with large flexibility. Preferably, the uniform color of the surface of the closure precursor is selected from the group consisting of white, yellow, orange, ocher, and mixtures thereof, in particular from the group consisting of RAL 9001, RAL 9010, RAL 1000, RAL 1001, RAL 1002, RAL 1014, RAL 1015, RAL 8001, and mixtures thereof. More preferably, the uniform color of the surface of the closure precursor is selected from the group consisting of RAL 9001, RAL 9010, RAL 1000, RAL 1015, and mixtures thereof. Surfaces that have an aforementioned uniform color provide a clear canvas on which a decorative layer can be applied, in particular printed, with large flexibility.

The details mentioned herein concerning the decorative layer in relation to the closure of the invention likewise also apply to the decorative layer of the method of the invention, and vice versa.

The method may comprise further steps. According to an embodiment, the method comprises, prior to the step of passing the closure precursor through the decorative layer application system, a step of passing the closure precursor through an undercoating layer application system for applying an undercoating layer having a substantially uniform color to obtain a closure precursor with a substantially uniform color on at least the lateral surface of the closure precursor.

The details mentioned herein concerning the undercoating layer in relation to the closure of the invention likewise also apply to the undercoating layer of the method of the invention, and vice versa.

Different application systems can be used for the decorative layer application system and/or the undercoating layer application system. The same type of system can be used for the decorative layer application system and the undercoating layer application system. However, it is also possible to employ different application systems for the decorative layer system and the undercoating layer application system. The two systems can be selected independently. Preferably, the decorative layer application system and/or the undercoating layer application system are independently selected from an inkjet printing system, a pad printing system, and a water transfer printing system, in particular a pad printing system.

According to an embodiment, the method for applying a decorative layer on a closure precursor further comprises the step of passing the closure precursor through an ornamental layer application system for applying an ornamental layer on the decorative layer. The details mentioned herein concerning the ornamental layer in relation to the closure of the invention likewise also apply to the ornamental layer of the method of the invention, and vice versa.

During application of the decorative layer, it is advantageous if the closure precursor is rotated around the longitudinal axis.

Also during application of the undercoating layer, it is advantageous if the closure precursor is rotated around the longitudinal axis.

Further, during application of the ornamental layer, it is advantageous if the closure precursor is rotated around the longitudinal axis.

For the method for applying a decorative layer on a closure precursor, the different closure precursors as described herein can be employed.

The invention also relates to the use of a closure according to the invention for sealing a container.

The present disclosure accordingly comprises an article of manufacture possessing the features, properties, and relation of elements which will be exemplified in the article herein described, and the scope of the present disclosure will be indicated in the claims.

BRIEF DESCRIPTION OF THE DRAWINGS

For a fuller understanding of the nature and objects of the present disclosure herein described, reference should be had to the following detailed description taken in connection with the accompanying drawings, in which.

DETAILED DESCRIPTION

By referring to the Figures, along with the following detailed disclosure, the construction and production method for the closures of the present disclosure can best be understood. In these Figures, as well as in the detailed disclosure herein, the closure of the present disclosure, is depicted and discussed as a bottle closure for wine products. However, as detailed herein, the present disclosure is applicable as a closure for use in sealing and retaining any desired product in any desired closure system. However, due to the stringent and difficult demands placed upon closures for wine products, the detailed disclosure herein focuses upon the applicability of the bottle closures of the present disclosure as a closure for wine bottles. However, it is to be understood that this detailed discussion is provided merely for exemplary purposes and is not intended to limit the present disclosure to this particular application and embodiment.

Figure 1:
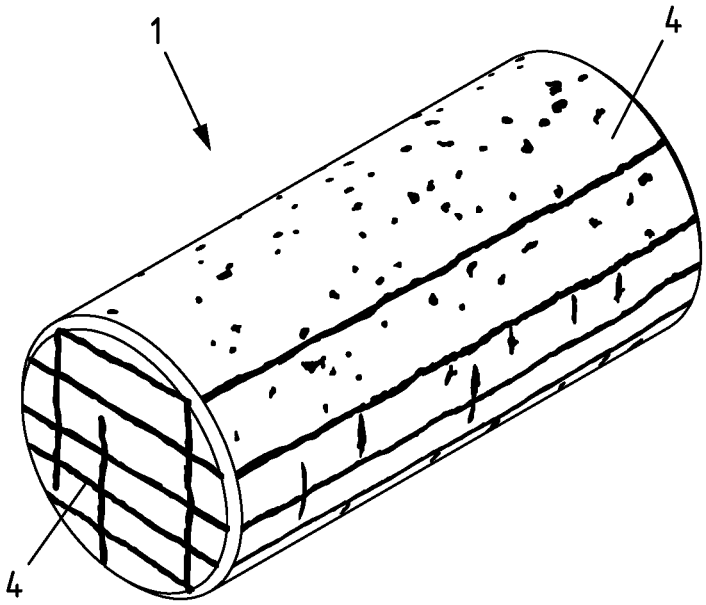
FIG. 1 is a perspective view of a closure according to an aspect of the present disclosure, comprising an undercoating layer (not shown in FIG. 1)
Figure 2:
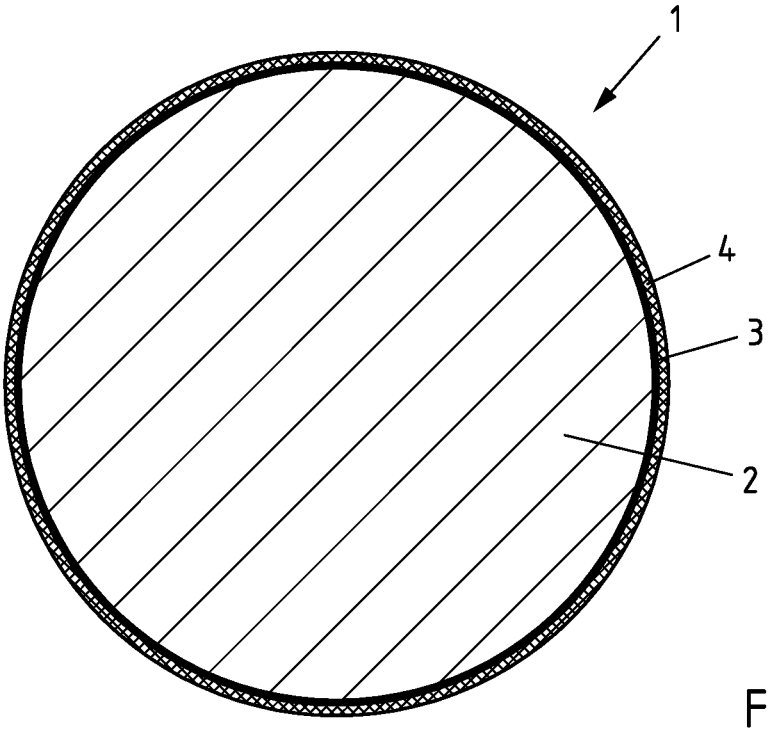
FIG. 2 is a cross sectional of a closure according to an aspect of the present disclosure, comprising an undercoating layer.

In FIGS. 1 and 2, the exemplary construction of a closure 1 is depicted comprising a generally cylindrical shape formed by closure precursor 2 and preferably undercoating layer 3 comprising an undercoating layer surface that forms the surface of closure precursor 2. In this aspect, closure precursor 2 comprises a substantially cylindrically shaped surface, terminating with substantially flat end surfaces. On top of undercoating layer 3, closure 1 comprises decorative layer 4. Whenever applicable, the following detailed description of a closure having an undercoating layer shall also apply to closures without an undercoating layer.

In an exemplary aspect, undercoating layer 3 comprises a pigment, in particular in a range from 0 to 2 wt. %. In this way, undercoating layer 3 has a uniform color. Preferably the color of the undercoating layer 3 is white, in particular RAL 9001. Undercoating layer 3 particularly forms the lateral surface and the flat terminating surfaces of closure precursor 2. Undercoating layer [[4]]3 is preferably applied by printing.

In this exemplary aspect, closure 1 also comprises decorative layer 4 that covers both the lateral surface and the flat terminating surfaces of closure precursor 2. Decorative layer 4, thus, covers undercoating layer 3 entirely. Decorative layer 4 is preferably applied by pad printing. Decorative layer 4 preferably depicts a first indicia, in particular a photograph of a natural cork look. Thus, decorative layer 4 particularly has a print resolution of 300 dpi or more and is polychromatic comprising one or more shades of two or more colors. Preferably, decorative layer 4 consists of one or more materials that are compliant or approved as food contact substances by the FDA and the EU.

Figure 3:
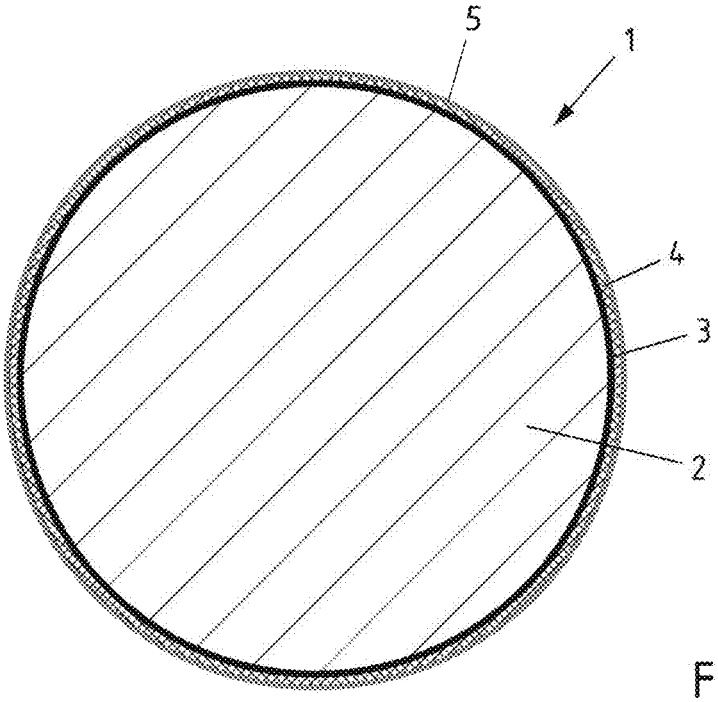
FIG. 3 is a cross sectional of a closure according to an aspect of the present disclosure, comprising the items shown in FIG. 2 plus an external ornamental layer.

FIG. 3 illustrates a closure 1 according to one embodiment substantially identical to that shown in FIGS. 1 and 2, but with addition of an ornamental layer 5 arranged to surround at least a portion of the decorative layer 4. The remaining items of FIG. 3 may be identical to those described in connection with FIGS. 1 and 2.

In order to assist in assuring entry of bottle closure 1 into the portal of the bottle into which closure 1 is inserted, the terminating edges may be beveled or chamfered. Similarly, the terminating edges may comprise a similar bevel or chamfer. Although any desired bevel or chamfered configuration can be employed, such as a radius, curve, or flat surface, it has been found that by merely cutting the terminating edges with an angle of about 45° or about 60° the desired reduced diameter area is provided for achieving the desired effect. The chamfer angle and the chamfer length, i.e. the length of the chamfered surface, are exemplarily within the ranges described herein for still wine closures or champagne closures.

By incorporating chamfered or beveled ends on bottle closure 1, automatic self-centering is attained. As a result, when bottle closure 1 is compressed and ejected from the compression jaws into the open bottle for forming the closure thereof, bottle closure 1 is automatically guided into the bottle opening, even if the clamping jaws are slightly misaligned with the portal of the bottle. By employing this configuration, unwanted difficulties in inserting bottle closure 1 into any desired bottle are obviated. However, in applications which employ alternate stopper insertion techniques, chamfering of the terminating ends may not be needed. Further, in order to facilitate the insertion of the closure into the bottle neck, the outer surface can fully or partly be coated with suitable lubricants, for example with silicones. Coating with a lubricant can be carried out by a variety of techniques known in the art, including tumbling and/or extrusion coating. For closures for champagne or sparkling wine, if a silicone lubricant is used a crosslinkable silicone is preferred since silicone can act as an antifoaming agent.

In this exemplary aspect depicted in FIGS. 1 and 2, in order to produce a closure that imitates a closure made from a single piece of cork, closure precursor 2 contains cork particles in addition to plastic material. The plastic material is preferably foamed as described herein. The plastic material is preferably biodegradable, thus yielding a biodegradable closure. Hence, with decorative layer 4 depicting natural cork look and closure precursor 2 comprising cork particles, a closure is obtained that looks and smells like a closure made from a single piece of cork. The cork particles preferably have a content of releasable trichloroanisole measured according to the test method defined herein of less than 2 ng/L.

While the Figures show cylindrical closures, closures for sparkling wine bottles are also encompassed by the invention.

Any embodiment or aspect described or defined herein, whether defining a closure, a composition, or a method, may be combined with any other aspect or embodiment, or any features thereof, whether defining a closure, a composition, or a method, even when such a combination is not explicitly stated. All combinations of embodiments, aspects and features are within the scope of the present invention. In particular, any aspect of any claim may be combined with any aspect of any one of more claims. Where numerical ranges are defined, any numerical limit of any range may be combined with any other numerical limit of the same range. For example, an upper limit of a range may be combined with an upper limit of a range, or a lower limit of a range may be combined with a lower limit of a range, or an upper limit of a range may be combined with a lower limit of a range, while remaining within the scope of the present invention.

Test Methods:

The Mocon test for OTR/oxygen ingress rate was carried out using 100% oxygen according to ASTM F-1307.

Extraction Force:

The test for extraction force was carried out on a random sample selection according to the methods described in WO 03/018304 A1 (extraction test, p. 48, l. 13-p. 49, l. 10), which are herewith incorporated and form part of the present disclosure. Three empty, clean "Bordeaux" style wine bottles were stoppered using a semi-automatic corking machine (Model 4040 from GAI S.p.A., Italy). The bottles were stored for one hour. The closures were then extracted at ambient temperature using a Dillon AFG-1000N force gauge (from Dillon/Quality Plus, Inc., USA) to measure the force required for extraction.

Surface Hardness:

The surface hardness is tested at room temperature (25° C.) using a Shore 902 automatic operating stand from Instron according to ASTM D2240-10.

Coefficient of Friction:

The dynamic coefficient of friction was measured according to ASTM D1894-14 at room temperature (25° C.) using an Instron Model 2810 Coefficient of Friction Testing Fixture. For the measurement of the dynamic coefficient of friction, a closure was split in half along its long axis and mounted to a steel plate with the flat side of the interior of the closure. This specimen was then loaded with 200 gram weight and pulled across a stainless steel surface at 15.2 cm/min.

Releasable Haloanisole

The amount of haloanisole released from a cork into wine can be measured as so-called "releasable haloanisole" by soaking a cork or a sample of corks in a wine for 24 hours for an untreated cork or 48 hours for a treated cork, and measuring the amount of each haloanisole compound in the wine by means of gas chromatography. An acceptable level is generally considered to be one which results in an amount of the respective chloroanisole or chloroanisoles in the wine which is below the average sensory threshold of about 6 ng/L for TCA or TBA, preferably less than about 2 ng/L.

The invention claimed is:

1. A closure constructed for being inserted and securely retained in a portal-forming neck of a container, the closure having a substantially cylindrical shape and comprising substantially flat terminating surfaces forming opposed ends of the closure, wherein the closure further comprises:

a. a closure precursor having a substantially cylindrical shape, and comprising a lateral surface and substantially flat terminating surfaces forming opposed ends of the closure precursor;

b. a printed pigment or dye undercoating layer contacting and covering (i) the lateral surface and (ii) the substantially flat terminating surfaces of the closure precursor, wherein the printed pigment or dye undercoating layer has a uniform color; and c. a decorative layer arranged in contact with the printed pigment or dye undercoating layer and that at least partially covers at least the lateral surface of the closure precursor.

2. The closure of claim 1, wherein the uniform color is selected from the group consisting of white, yellow, orange, ocher, and mixtures thereof.

3. The closure of claim 1, wherein the uniform color is selected from the group consisting of RAL 9001, RAL 9010, RAL 1000, RAL 1001, RAL 1002, RAL 1014, RAL 1015, RAL 8001, and mixtures thereof.

4. The closure of claim 1, wherein at least one of the closure or the closure precursor has a content of releasable trichloroanisole of less than 2 ng/L.

5. The closure of claim 1, wherein the closure has an overall density in the range of from 100 $kg/m^3$ to 500 $kg/m^3$.

6. The closure of claim 1, wherein the decorative layer entirely covers the lateral surface of the closure precursor.

7. The closure of claim 1, wherein the decorative layer at least partly covers the flat terminating surfaces of the closure precursor.

8. The closure of claim 1, wherein the decorative layer is a pigment or dye.

9. The closure of claim 1, wherein at least one of the printed pigment or dye undercoating layer or the decorative layer is applied by a process selected from the group consisting of: offset printing, pad printing, screen printing, inkjet printing, hot-foil transfer printing, fire branding, and laser printing.

10. The closure of claim 1, wherein the decorative layer has a print resolution of at least 25 dots per inch (dpi).

11. The closure of claim 1, wherein the decorative layer comprises one or more shades of two or more colors.

12. The closure of claim 1, wherein the decorative layer is monochromatic or polychromatic.

13. The closure of claim 1, wherein the decorative layer has photographic image quality in terms of sharpness, tone reproduction, and contrast.

14. The closure of claim 1, wherein the decorative layer consists of one or more materials that suitable for food contact, by being free of agents that could affect a taste or smell of consumable products susceptible to contacting the closure.

15. The closure of claim 1, wherein the decorative layer depicts a first indicia selected from the group consisting of letters, symbols, colors, graphics, icons, logos, wood tones, natural cork look, and photographs.

16. The closure of claim 1, further comprising an ornamental layer on top of the decorative layer.

17. The closure of claim 16, wherein the ornamental layer comprises at least one of the following features (i) to (iv):

(i) the ornamental layer comprises a pigment or dye, (ii) the ornamental layer is applied by a process selected from the group consisting of:

offset printing, pad printing, screen printing, inkjet printing, fire branding, hot-foil transfer printing, and laser printing, (iii) the ornamental layer depicts a second indicia selected from the group consisting of: letters, symbols, colors, graphics, icons, logos, wood tones, natural cork look, and photographs, and (iv) the ornamental layer consists of one or more materials that suitable for food contact, by being free of agents that could affect a taste or smell of consumable products susceptible to contacting the closure.

18. The closure of claim 1, wherein the closure precursor comprises 5 to 85 wt. % cork particles, based on a total weight of the closure precursor.

19. The closure of claim 18, wherein the cork particles have a particle size distribution D50 measured by means of mechanical sieving according to ISO ICS 19.120 in a range of from 0.25 millimeters to 5 millimeters.

20. The closure of claim 18, wherein the cork particles have a substantially isotropic shape.

21. The closure of claim 18, wherein the cork particles comprise at least one of the following features (i) to (iii):

(i) the cork particles have a content of releasable trichloroanisole measured according to a test method defined herein of less than 6 ng/L, (ii) the cork particles have a density in a range of 50 to 200 g/L, and (iii) the cork particles have a water content of less than 8 wt. %, based on a total weight of the cork particles.

22. The closure of claim 18, wherein the cork particles are bleached.

23. The closure of claim 18, wherein the cork particles are distributed homogeneously through the closure precursor.

24. The closure of claim 18, wherein the closure precursor is formed by one of monoextrusion, coextrusion, or injection molding.

25. The closure of claim 18, wherein the closure precursor comprises 1 to 49 wt. % of a first plastic material, based on the total weight of the closure precursor.

26. The closure of claim 25, wherein the closure precursor comprises 10 to 49 wt. % of a second plastic material, based on the total weight of the closure precursor.

27. The closure of claim 26, wherein the second plastic material is a thermoplastic material comprising a polymer elastomer gum, the polymer elastomer gum comprising one or more thermoplastic polymers selected from the group consisting of: polyethylenes; metallocene catalyst polyethylenes; polybutanes; polybutylenes; thermoplastic polyurethanes; silicones; vinyl-based resins; thermoplastic elastomers; polyesters; ethylenic acrylic copolymers; ethylene-vinyl-acetate copolymers; ethylene-methyl-acrylate copolymers; thermoplastic polyolefins; thermoplastic vulcanizates; flexible polyolefins; fluorelastomers; fluoropolymers; polytetrafluoroethylenes; ethylene-butyl-acrylate copolymers; ethylene-propylene-rubber; styrene butadiene rubber; styrene butadiene block copolymers; ethylene-ethyl-acrylic copolymers; ionomers; polypropylenes; copolymers of polypropylene and ethylenically unsaturated comonomers copolymerizable therewith; olefin copolymers; olefin block copolymers; cyclic olefin copolymers; styrene ethylene butadiene styrene block copolymers; styrene ethylene butylene styrene block copolymers; styrene ethylene butylene block copolymers; styrene butadiene styrene block copolymers; styrene butadiene block copolymers; styrene isoprene styrene block copolymers; styrene isobutylene block copolymers; styrene isoprene block copolymers; styrene ethylene propylene styrene block copolymers; styrene ethylene propylene block copolymers; polyvinylalcohol; polyvinylbutyral; polyhydroxyalkanoates; copolymers of hydroxyalkanoates and monomers of biodegradable polymers; polylactic acid; copolymers of lactic acid and monomers of biodegradable polymers; aliphatic copolyesters; aromatic-aliphatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly(butylenesuccinate-co-adipate); poly(trimethyleneterephthalate); poly(butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; polymers formed from monomer units selected from vinylidene chloride, acrylonitrile and methyl methacrylate; copolymers formed from two or more monomer units selected from vinylidene chloride, acrylonitrile and methyl methacrylate; PEF, PTF, bio-based polyesters, and combinations of any two or more thereof.

28. The closure of claim 26, wherein the second plastic material is a thermoplastic material comprising a polymer elastomer dispersion, and the polymer elastomer dispersion comprises one or more thermoplastic polymers selected from the group consisting of: aliphatic (co)polyesters, aliphatic aromatic copolyesters, EVA, olefinic polymers, metallocene polyethylene, and styrenic block copolymers.

29. The closure of claim 25, wherein the closure precursor comprises 0 to 10 wt. % of one or more blowing agents, 0 to 15 wt. % of one or more lubricants; and 0 to 10 wt. % of one or more additives and/or fillers, based on the total weight of the closure precursor.

30. The closure of claim 25, wherein the first plastic material comprises one or more thermoplastic polymers.

31. The closure of claim 25, wherein at least 90 wt. % of the first plastic material is biodegradable according to ASTM D6400.

32. The closure of claim 25, wherein the first plastic material independently comprises one or more thermoplastic polymers selected from the group consisting of: polyethylenes; metallocene catalyst polyethylenes; polybutanes; polybutylenes; thermoplastic polyurethanes; silicones; vinyl-based resins; thermoplastic elastomers; polyesters; ethylenic acrylic copolymers; ethylene-vinyl-acetate copolymers; ethylene-methyl-acrylate copolymers; thermoplastic polyolefins; thermoplastic vulcanizates; flexible polyolefins; fluorelastomers; fluoropolymers; polytetrafluoroethylenes; ethylene-butyl-acrylate copolymers; ethylene-propylene-rubber; styrene butadiene rubber; styrene butadiene block copolymers; ethylene-ethyl-acrylic copolymers; ionomers; polypropylenes; copolymers of polypropylene and ethylenically unsaturated comonomers copolymerizable therewith; olefin copolymers; olefin block copolymers; cyclic olefin copolymers; styrene ethylene butadiene styrene block copolymers; styrene ethylene butylene styrene block copolymers; styrene ethylene butylene block copolymers; styrene butadiene styrene block copolymers; styrene butadiene block copolymers; styrene isoprene styrene block copolymers; styrene isobutylene block copolymers; styrene isoprene block copolymers; styrene ethylene propylene styrene block copolymers; styrene ethylene propylene block copolymers; polyvinylalcohol; polyvinylbutyral; polyhydroxyalkanoates; copolymers of hydroxyalkanoates and monomers of biodegradable polymers; polylactic acid; copolymers of lactic acid and monomers of biodegradable polymers; aliphatic copolyesters; aromatic-aliphatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly(butylenesuccinate-co-adipate); poly(trimethyleneterephthalate); poly(butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; polymers formed from monomer units selected from vinylidene chloride, acrylonitrile and methyl methacrylate; copolymers formed from two or more monomer units selected from vinylidene chloride, acrylonitrile and methyl methacrylate; PEF, PTF, bio-based polyesters, and combinations of any two or more thereof.

33. The closure of claim 25, wherein the first plastic material independently comprises one or more thermoplastic polymers selected from the group consisting of: aliphatic (co)polyesters, aliphatic aromatic copolyesters, EVA, olefinic polymers, metallocene polyethylene, and styrenic block copolymers.

34. The closure of claim 25, wherein the first plastic material independently comprises one or more thermoplastic polymers selected from the group consisting of: aliphatic (co)polyesters and aliphatic aromatic copolyesters.

35. The closure of claim 25, wherein the first plastic material comprises one or more thermoplastic polymers having a melt flow index (MFI) as determined by ISO 1133-1 (190° C., 2.14 kg) of greater than 1 g/10 min.

36. The closure of claim 25, comprising at least one of the following features (i) or (ii): (i) the first plastic material is essentially free of a material selected from the group consisting of: thermoset polymers, crosslinkable polymers, curable polymers and non-thermoplastic polymers, and (ii) the first plastic material is essentially free of polyurethane.

37. The closure of claim 25, wherein the first plastic material comprises a polymer matrix comprising a plurality of cells.

38. The closure of claim 37, wherein the plurality of cells is a plurality of substantially closed cells, and/or the plurality of cells has an average cell size in a range of from about 0.025 mm to about 0.5 mm.

39. The closure of claim 37, wherein at least one of a size or a distribution of cells of the plurality of cells in the closure precursor is substantially uniform throughout at least one of a length or a diameter of the closure precursor,.

40. The closure of claim 1, wherein from 1% by weight to 49% by weight of the closure precursor, based on an entire weight of the closure precursor, is biodegradable according to ASTM D6400.

41. The closure of claim 1, comprising at least one of the following features (i) or (ii): (i) the closure is substantially free of thermoset polymers including polyurethane, and (ii) the closure is substantially free of reactive and non-reactive adhesives.

42. The closure of claim 1, wherein the closure precursor comprises:

a. a substantially cylindrically shaped core member comprising at least one thermoplastic polymer, wherein the core member comprises terminating end surfaces forming opposed ends of the core member, b. a peripheral layer at least partially surrounding and intimately bonded to a cylindrical surface of the core member with the end surfaces of the core member being devoid of the peripheral layer, the peripheral layer comprising at least one thermoplastic polymer and a lateral layer surface, wherein the lateral layer surface of the closure precursor is formed by the lateral layer surface and the substantially flat terminating surfaces forming the opposed ends of the closure precursor are substantially formed by the terminating end surfaces of the core member.

43. The closure of claim 42, wherein the at least one thermoplastic polymer of the core member is selected from the group consisting of: polyethylenes; metallocene catalyst polyethylenes; polybutanes; polybutylenes; thermoplastic polyurethanes; silicones; vinyl-based resins; thermoplastic elastomers; polyesters; ethylenic acrylic copolymers; ethylene-vinyl-acetate copolymers; ethylene-methyl-acrylate copolymers; thermoplastic polyolefins; thermoplastic vulcanizates; flexible polyolefins; fluorelastomers; fluoropolymers; polytetrafluoroethylenes; ethylene-butyl-acrylate copolymers; ethylene-propylene-rubber; styrene butadiene rubber; styrene butadiene block copolymers; ethylene-ethyl-acrylic copolymers; ionomers; polypropylenes; copolymers of polypropylene and ethylenically unsaturated comonomers copolymerizable therewith; olefin copolymers; olefin block copolymers; cyclic olefin copolymers; styrene ethylene butadiene styrene block copolymers; styrene ethylene butylene styrene block copolymers; styrene ethylene butylene block copolymers; styrene butadiene styrene block copolymers; styrene butadiene block copolymers; styrene isoprene styrene block copolymers; styrene isobutylene block copolymers; styrene isoprene block copolymers; styrene ethylene propylene styrene block copolymers; styrene ethylene propylene block copolymers; polyvinylalcohol; polyvinylbutyral; polyhydroxyalkanoates; copolymers of hydroxyalkanoates and monomers of biodegradable polymers; polylactic acid; copolymers of lactic acid and monomers of biodegradable polymers; aliphatic copolyesters; aromatic-aliphatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly(butylenesuccinate-co-adipate); poly(trimethyleneterephthalate); poly (butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; polymers formed from monomer units selected from vinylidene chloride, acrylonitrile and methyl methacrylate; copolymers formed from two or more monomer units selected from vinylidene chloride, acrylonitrile and methyl methacrylate; PEF, PTF, bio-based polyesters, and combinations of any two or more thereof.

44. The closure of claim 42, wherein the at least one thermoplastic polymer of the peripheral layer is selected from the group consisting of: polyethylenes; metallocene catalyst polyethylenes; polybutanes; polybutylenes; thermoplastic polyurethanes; silicones; vinyl-based resins; thermoplastic elastomers; polyesters; ethylenic acrylic copolymers; ethylene-vinyl-acetate copolymers; ethylene-methyl-acrylate copolymers; thermoplastic polyolefins; thermoplastic vulcanizates; flexible polyolefins; fluorelastomers; fluoropolymers; polytetrafluoroethylenes; ethylene-butyl-acrylate copolymers; ethylene-propylene-rubber; styrene butadiene rubber; styrene butadiene block copolymers; ethylene-ethyl-acrylic copolymers; ionomers; polypropylenes; copolymers of polypropylene and ethylenically unsaturated comonomers copolymerizable therewith; olefin copolymers; olefin block copolymers; cyclic olefin copolymers; styrene ethylene butadiene styrene block copolymers; styrene ethylene butylene styrene block copolymers; styrene ethylene butylene block copolymers; styrene butadiene styrene block copolymers; styrene butadiene block copolymers; styrene isoprene styrene block copolymers; styrene isobutylene block copolymers; styrene isoprene block copolymers; styrene ethylene propylene styrene block copolymers; styrene ethylene propylene block copolymers; polyvinylalcohol; polyvinylbutyral; polyhydroxyalkanoates; copolymers of hydroxyalkanoates and monomers of biodegradable polymers; polylactic acid; copolymers of lactic acid and monomers of biodegradable polymers; aliphatic copolyesters; aromatic-aliphatic copolyesters; polycaprolactone; polyglycolide; poly(3-hydroxybutyrate); poly(3-hydroxybutyrate-co-3-hydroxyvalerate); poly(3-hydroxybutyrate-co-3-hydroxyhexanoate); poly(butylenesuccinate); poly(butylenesuccinate-co-adipate); poly(trimethyleneterephthalate); poly (butylenadipate-co-terephthalate); poly(butylenesuccinate-co-terephthalate); poly(butylenesebacate-co-terephthalate); lactic acid caprolactone lactic acid copolymers; lactic acid ethylene oxide lactic acid copolymers; polymers formed from monomer units selected from vinylidene chloride, acrylonitrile and methyl methacrylate; copolymers formed from two or more monomer units selected from vinylidene chloride, acrylonitrile and methyl methacrylate; PEF, PTF, bio-based polyesters, and combinations of any two or more thereof.

45. The closure of claim 42, wherein the closure comprises cork particles.

46. The closure of claim 42, wherein the core member comprises at least one of the following features (i) or (ii): (i) the core member comprises a plurality of substantially closed cells, and (ii) the core member is foamed.

47. The closure of claim 42, wherein the peripheral layer comprises at least one of the following features (i) or (ii): (i) the core member comprises a plurality of substantially closed cells, and (ii) the peripheral layer is foamed.

48. The closure of claim 42, wherein the core member comprises a plurality of substantially closed cells having a cell size in a range of from about 0.02 mm to about 0.5 mm.

49. The closure of claim 48, wherein at least one of a size and a distribution of the plurality of substantially closed cells in the core member is substantially uniform throughout at least one of a length and a diameter of the core member.

50. The closure of claim 42, wherein the peripheral layer comprises a plurality of substantially closed cells having a cell size in a range of from about 0.02 mm to about 0.5 mm.

51. The closure of claim 42, wherein the core member comprises closed cells having at least one of the following properties (i) or (ii): (i) an average cell size in a range of from about 0.02 mm to about 0.50 mm, and (ii) a cell density in a range of from about 8,000 cells/$cm^3$ to about 25,000,000 cells/$cm^3$.

52. The closure of claim 42, wherein the peripheral layer is comprises at least one of the following properties (i) or (ii): a thickness in a range of from 0.05 mm to 5 mm, and (ii) a density in a range of from 300 kg/$m^3$ to 1500 kg/$m^3$.

53. The closure of claim 1, wherein the closure comprises at least one of the following features (i) to (iii): (i) the closure has an oxygen ingress rate measured according to ASTM F1307 of less than about 5 mg oxygen per container in the first 100 days after closing the container, (ii) the closure has an oxygen transfer rate measured according to ASTM F1307 in 100% oxygen of less than 0.05 cc/day, and (iii) the closure has a moisture rate as determined by ISO 9727-3 of less than 8 wt. %.

54. The closure of claim 1, wherein the closure precursor contains 0 to 2 wt. % of at least one pigment or dye present within the printed pigment or dye undercoating layer, or present within the printed pigment or dye undercoating layer as well as in the decorative layer.

55. The closure of claim 54, wherein the at least one pigment or dye comprises a pigment, and the pigment comprises at least one of antimony(III) oxide ($Sb_2O_3$), barium sulfate ($BaSO_4$), lithopone ($BaSO_4$*ZnS), calcium carbonate, titanium oxide ($TiO_2$), and zinc oxide (ZnO).

56. The closure of claim 1, wherein the decorative layer comprises a photographic representation of natural cork.

* * * * *